US010350901B2

(12) United States Patent
Mizutani et al.

(10) Patent No.: US 10,350,901 B2
(45) Date of Patent: Jul. 16, 2019

(54) INK BOTTLE

(71) Applicant: Seiko Epson Corporation, Tokyo (JP)

(72) Inventors: Tadahiro Mizutani, Shiojiri (JP); Koichi Toba, Shiojiri (JP); Ryoichi Tanaka, Shiojiri (JP); Taku Ishizawa, Matsumoto (JP); Manabu Akahane, Tatsuno-machi (JP); Tadashi Watanabe, Matsumoto (JP); Noriyuki Fukasawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/615,525

(22) Filed: Jun. 6, 2017

(65) Prior Publication Data

US 2017/0355191 A1 Dec. 14, 2017

(30) Foreign Application Priority Data

Jun. 10, 2016 (JP) ..... 2016-116155
Oct. 17, 2016 (JP) ..... 2016-203332
Oct. 25, 2016 (JP) ..... 2016-208864

(51) Int. Cl.
*B41J 2/175* (2006.01)

(52) U.S. Cl.
CPC ..... *B41J 2/17553* (2013.01); *B41J 2/1752* (2013.01); *B41J 2/17503* (2013.01);
(Continued)

(58) Field of Classification Search
CPC ..... B41J 2/17553; B41J 2/17523; B41J 2/17503; B41J 2/17509; B41J 2/17513;
(Continued)

(56) References Cited

U.S. PATENT DOCUMENTS 6,164,768 A 12/2000 Murphy et al.
7,300,138 B2 * 11/2007 Corner ..... B41J 2/17513 347/84

(Continued)

FOREIGN PATENT DOCUMENTS

CN 204382821 U 6/2015
EP 3 075 540 A1 10/2016

(Continued)

OTHER PUBLICATIONS

Office Action dated May 31, 2018 in co-pending U.S. Appl. No. 15/617,682 (8 pgs.).

(Continued)

*Primary Examiner* — Geoffrey S Mruk
(74) *Attorney, Agent, or Firm* — Foley & Lardner LLP

(57) ABSTRACT

An ink bottle comprises a container main body configured to contain ink that is to be supplied to an ink tank, an ink outlet forming portion provided on an end of the container main body and configured to include an ink outlet that causes the ink to be flowed out from the container main body, and a valve provided in the ink outlet forming portion and configured to seal the ink outlet in an openable and closable manner. The ink outlet is formed in an end face of the ink outlet forming portion. The end face is arranged to face an opposite side of the ink outlet forming portion that is opposite to a container main body side thereof. A first recess is formed in an outer side portion of the ink outlet on the end face to be recessed toward the container main body side.

14 Claims, 19 Drawing Sheets

(52) U.S. Cl.
CPC ..... *B41J 2/17509* (2013.01); *B41J 2/17513* (2013.01); *B41J 2/17523* (2013.01); *B41J 2/17596* (2013.01); *B41J 2/17536* (2013.01)

(58) Field of Classification Search
CPC ... B41J 2/17596; B41J 2/1752; B41J 2/17536
See application file for complete search history.

(56) References Cited

U.S. PATENT DOCUMENTS

| | | | | |
|---|---|---|---|---|
| 7,458,665 | B2 * | 12/2008 | Batista | B41J 2/17509 222/83 |
| 9,090,075 | B2 | 7/2015 | Matsumoto et al. | |
| 9,199,769 | B2 | 12/2015 | Wood et al. | |
| 2004/0061748 | A1 | 4/2004 | Kuwabara et al. | |
| 2012/0125481 | A1 | 5/2012 | Matsumoto et al. | |
| 2014/0104349 | A1 | 4/2014 | Kimura et al. | |
| 2015/0124028 | A1 | 5/2015 | Kimura et al. | |
| 2015/0283816 | A1 | 10/2015 | Kimura et al. | |
| 2016/0121619 | A1 | 5/2016 | Tomoguchi | |
| 2016/0200110 | A1 | 7/2016 | Matsushita et al. | |
| 2016/0200111 | A1 | 7/2016 | Kimura et al. | |
| 2017/0120606 | A1 | 5/2017 | Koshikawa et al. | |
| 2017/0313089 | A1 | 11/2017 | Matsushita et al. | |
| 2017/0355194 | A1 | 12/2017 | Fukasawa et al. | |
| 2017/0355195 | A1 | 12/2017 | Fukasawa et al. | |

FOREIGN PATENT DOCUMENTS

| | | | |
|---|---|---|---|
| JP | S58-107348 | A | 6/1983 |
| JP | 3021835 | U | 3/1996 |
| JP | 2001-088317 | A | 4/2001 |
| JP | 2001-146021 | A | 5/2001 |
| JP | 2004-142442 | A | 5/2004 |
| JP | 2006-263960 | A | 10/2006 |
| JP | 2012-106363 | A | 6/2012 |
| JP | 2014-079909 | A | 5/2014 |
| JP | 2014-088207 | A | 5/2014 |
| JP | 2016-087844 | A | 5/2016 |
| JP | 2016-102824 | A | 6/2016 |
| WO | WO-2015/079547 | A1 | 6/2015 |

OTHER PUBLICATIONS

Office Action dated May 31, 2018 in co-pending U.S. Appl. No. 15/617,782 (8 pgs.).

Final Office Action dated Oct. 19, 2018 in co-pending U.S. Appl. No. 15/617,682 (9 pgs.).

International Search Report dated Aug. 22, 2017 in PCT/JP2017/021057 with English-language translation (4 pgs.).

International Search Report dated Aug. 22, 2017 in PCT/JP2017/021276 with English-language translation (4 pgs.).

* cited by examiner

INK BOTTLE

CROSS-REFERENCE TO RELATED APPLICATION

The present application claims priority from Japanese patent applications No. 2016-203332 filed on Oct. 17, 2016, No. 2016-116155 filed on Jun. 10, 2016 and No. 2016-208864 filed on Oct. 25, 2016, the entirety of the content of which are hereby incorporated by reference into this application.

BACKGROUND

Field

The disclosure relates to an ink bottle.

Related Art

A conventionally known inkjet printer as one example of an ink ejection apparatus is configured to eject ink from a record head toward a recording medium such as recording paper, such as to perform printing on the recording medium with the ink. The inkjet printer may be configured to allow the user to supply ink to a tank provided to store ink that is to be supplied to the record head. There is also a bottle (ink bottle) known to be suitable for injection of ink into the tank (as described in, for example, JP 2014-88207A).

When the bottle described in JP 2014-88207A is inclined downward or is conveyed, the ink contained in the bottle may leak out from an outlet. This is one potential factor damaging the convenience of the bottle. There is accordingly still a room for improvement with regard to the conventional configuration of the bottle. An object of the present disclosure is thus to enhance the convenience of such an ink bottle.

SUMMARY

According to one aspect of the disclosure, there is provided an ink bottle. The ink bottle comprises a container main body configured to contain ink that is to be supplied to an ink tank, an ink outlet forming portion provided on an end of the container main body and configured to include an ink outlet that causes the ink to be flowed out from the container main body, and a valve provided in the ink outlet forming portion and configured to seal the ink outlet in an openable and closable manner.

The ink outlet is formed in an end face of the ink outlet forming portion. The end face is arranged to face an opposite side of the ink outlet forming portion that is opposite to a container main body side thereof. A first recess is formed in an outer side portion of the ink outlet on the end face to be recessed toward the container main body side.

DETAILED DESCRIPTION

An embodiment of an ink ejection system and a bottle set is described below with reference to the drawings. In the respective illustrations, different scales may be employed for the respective configurations or for the respective components, in order to make the size of each of the configurations and the components recognizable.

Figure 1:
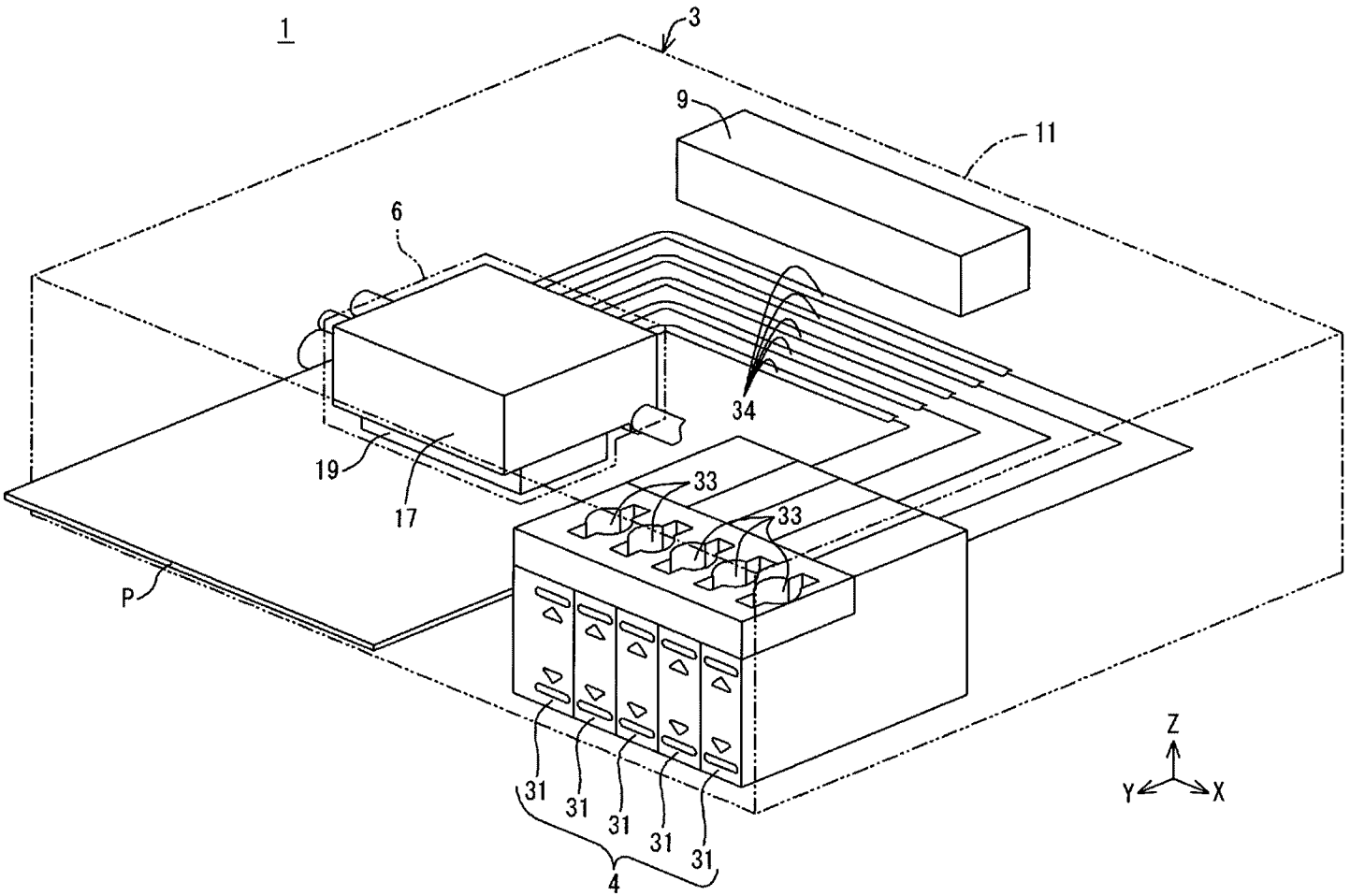
FIG. 1 is a perspective view schematically illustrating the main configuration of an ink ejection system according to an embodiment.

As illustrated in FIG. 1, an ink ejection system 1 according to one embodiment is configured to include an inkjet printer 3 as one example of ink ejection apparatus and an ink supply device 4. The printer 3 includes a recorder 6 and a controller 9. XYZ axes that are coordinate axes orthogonal to one another are shown in FIG. 1. XYZ axes may also be shown in subsequent drawings as necessary. In this case, the XYZ axes in the respective drawings correspond to the XYZ axes in FIG. 1. FIG. 1 illustrates the state that the ink ejection system 1 is placed in an XY plane that is defined by the X axis and the Y axis. According to this embodiment, the state that the ink ejection system 1 is placed in the XY plane adjusted to a horizontal plane is called the use state of the ink ejection system 1. The attitude of the ink ejection system 1 that is placed in the XY plane adjusted to the horizontal plane is called the use attitude of the ink ejection system 1.

The horizontal plane herein means a practically horizontal plane. The expression of "practically horizontal" may include some inclination in an allowable inclination range, for example, with regard to the plane on which the ink ejection system 1 is placed. The practically horizontal plane is accordingly not limited to a plane formed with high accuracy, such as a surface plate. The practically horizontal plane includes various surfaces of, for example, a desk, a rack, a shelf and a floor on which the ink ejection system 1 is mounted in use. A vertical direction is not strictly limited to a direction along the direction of gravity but includes a direction perpendicular to the practically horizontal plane.

For example, when the practically horizontal plane is a surface of the desk, the rack, the shelf or the floor, the vertical direction indicates the direction perpendicular to this surface.

In the description below, when the X axis, the Y axis and the Z axis are shown in the illustration and the description of each of the components and the units included in the ink ejection system 1, the X axis, the Y axis and the Z axis indicate the X axis, the Y axis and the Z axis in the state that the component or the unit is built in (mounted in) the ink ejection system 1. The attitude of each of the components and the units in the use attitude of the ink ejection system 1 is also called the use attitude of the component or the unit. In the description below, the description of the ink ejection system 1, the component or the unit means the description in the use attitude of the ink ejection system 1, the component or the unit, unless otherwise specified.

The Z axis is an axis orthogonal to the XY plane. In the use state of the ink ejection system 1, a +Z-axis direction shown in FIG. 1 is vertically upward direction. In the use attitude of the ink ejection system 1, a −Z-axis direction shown in FIG. 1 is vertically downward direction. With respect to each of the X axis, the Y axis and the Z axis, the direction of an arrow indicates + (positive) direction, and an opposite direction to the direction of the arrow indicates − (negative) direction. The vertically upward direction or vertically upward means the upward direction or upward along a vertical line. Similarly the vertically downward direction or vertically downward means the downward direction or downward along the vertical line. Upward direction or upward without the expression of "vertically" is not limited to the upward direction or upward along the vertical line but includes any upward direction or upward along a direction intersecting the vertical line other than the horizontal direction. Similarly downward direction or downward without the expression of "vertically" is not limited to the downward direction or downward along the vertical line but includes any downward direction or downward along the direction intersecting the vertical line other than the horizontal direction.

The printer 3 is configured such that the recorder 6 and the controller 9 are placed in a housing 11. The recorder 6 is configured to perform recording with ink as one example of liquid on a recording medium P that is fed in the Y-axis direction by a feeder device (not shown). The feeder device (not shown) is configured to feed the recording medium P such as recording paper intermittently in the Y-axis direction. The recorder 6 is configured to be movable back and force along the X axis by means of a moving device (not shown). The ink supply device 4 is configured to supply inks to the recorder 6. The controller 9 is configured to control the operations of these respective components.

A direction along the X axis herein is not limited to a direction perfectly parallel to the X axis but includes any direction inclined to the X axis by an error, a tolerance or the like, except a direction orthogonal to the X axis. Similarly a direction along the Y axis herein is not limited to a direction perfectly parallel to the Y axis but includes any direction inclined to the Y axis by an error, a tolerance or the like, except a direction orthogonal to the Y axis. A direction along the Z axis herein is not limited to a direction perfectly parallel to the Z axis but includes any direction inclined to the Z axis by an error, a tolerance or the like, except a direction orthogonal to the Z axis. In general, a direction along an arbitrary axis or along an arbitrary plane is not limited to a direction perfectly parallel to the arbitrary axis or the arbitrary plane but includes any direction inclined to the arbitrary axis or the arbitrary plane by an error, a tolerance or the like, except a direction orthogonal to the arbitrary axis or the arbitrary plane.

The recorder 6 is configured to include a carriage 17 and a record head 19. The record head 19 is an example of ink ejection structure and is configured to eject ink in the form of ink droplets and thereby perform recording on the recording medium P. The record head 19 is mounted on the carriage 17. The record head 19 is electrically connected with the controller 9. Ejection of ink droplets from the record head 19 is controlled by the controller 9.

As illustrated in FIG. 1, the ink supply device 4 is configured to include an ink tank 31. According to this embodiment, the ink supply device 4 includes a plurality of (five in this embodiment) ink tanks 31. The plurality of ink tanks 31 are placed inside of the housing 11. More specifically, the plurality of ink tanks 31 are placed, along with the record head 19 and ink supply tubes 34, inside of the housing 11. This configuration enables the ink tanks 31 to be protected by the housing 11. According to a modification, the plurality of ink tanks 31 may be placed outside of the housing 11. In this modification, the ink supply device 4 may be provided as a separate body from the printer 3.

The ink tank 31 is configured to contain ink therein. The ink tank 31 is also configured to include an ink inlet 33. Ink is injected through the ink inlet 33 from outside of the ink tank 31 into inside of the ink tank 31. The configuration of the ink tank 31 allows the ink inlet 33 of the ink tank 31 to be accessed from outside of the housing 11 by the operator.

An ink supply tube 34 is connected with each of the ink tanks 31. The ink contained in the ink tank 31 is supplied from the ink supply device 4 through the ink supply tube 34 to the record head 19. The ink supplied to the record head 19 is ejected in the form of ink droplets from nozzles (not shown) that are arranged to face the recording medium P. In the description of this embodiment, the printer 3 and the ink supply device 4 are configured to be integrated with each other. According to a modification, however, the printer 3 and the ink supply device 4 may be configured as separate bodies.

In the ink ejection system 1 having the above configuration, while the recording medium P is fed in the Y-axis direction and the carriage 17 is moved back and forth along the X axis, the record head 19 ejects ink droplets at predetermined positions, such as to perform recording on the recording medium P. These series of operations are controlled by the controller 9.

The ink herein is not limited to one of water-based ink and oil-based ink. The water-based ink herein may be configured by dissolving a solute such as a dye in an aqueous solvent or by dispersing a dispersoid such as a pigment in an aqueous dispersion medium. The oil-based ink herein may be configured by dissolving a solute such as a dye in an oily solvent or by dispersing a dispersoid such as a pigment in an oily dispersion medium.

Figure 2:
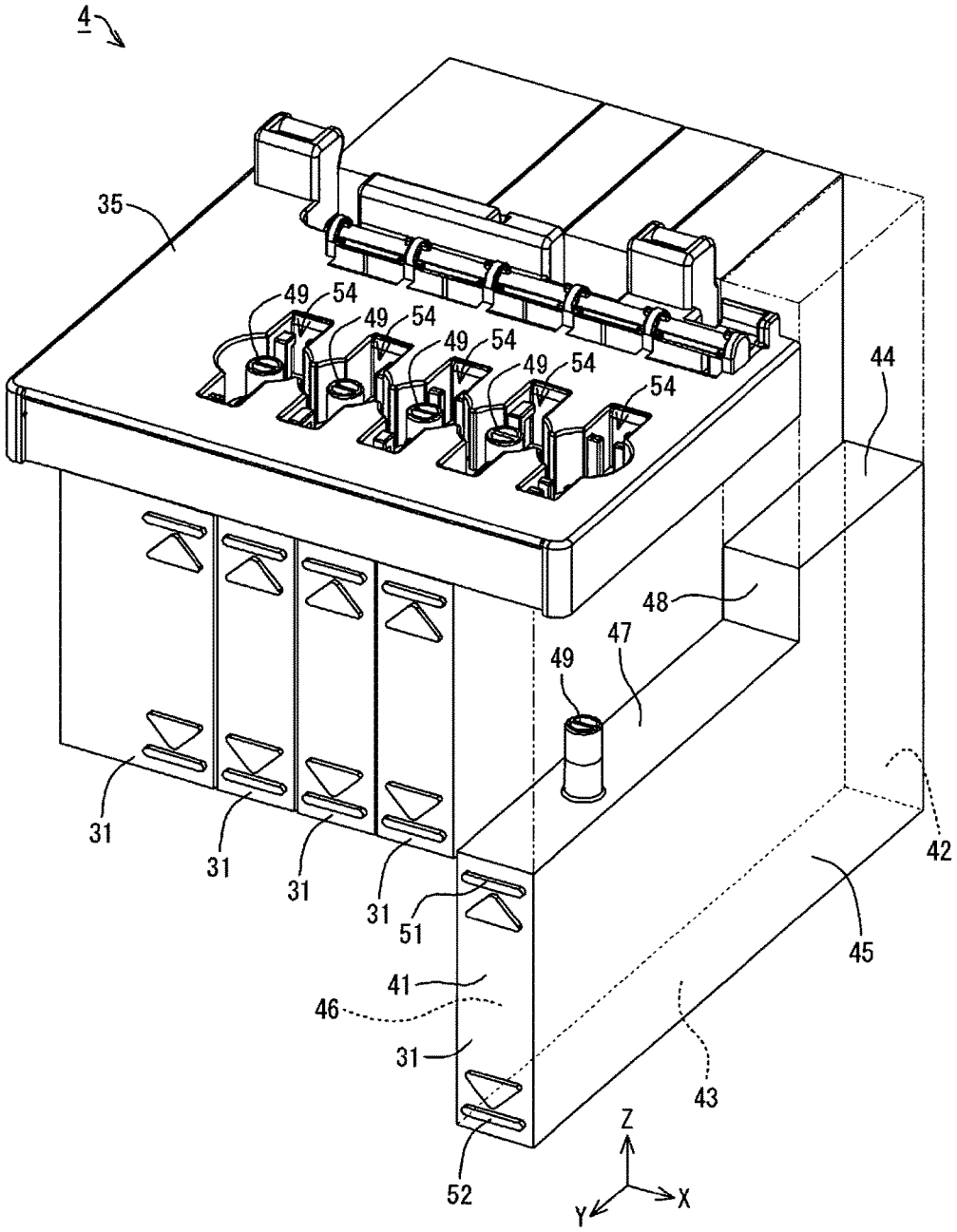
FIG. 2 is an exploded perspective view illustrating the main configuration of an ink supply device according to the embodiment.

As illustrated in FIG. 2, the ink supply device 4 is configured to include the plurality of ink tanks 31 and an adapter 35. The plurality of ink tanks 31 are arrayed along the X axis and have configurations and shapes identical with one another. The ink supply device 4 is configured, such that the plurality of ink tanks 31 are attached to and are thereby unified by the adapter 35. For the purpose of easy understanding of the configuration, FIG. 2 illustrates the state that one ink tank 31 among the plurality of ink tanks 31 is detached from the adapter 35.

According to this embodiment, different types of inks may be contained respectively in the plurality of ink tanks 31 or an identical type of ink may be contained in the plurality of ink tanks 31. The type of ink herein means, for example, the color of ink. For example, according to this embodiment, different colors of inks may be contained respectively in the plurality of ink tanks 31 or an identical color of ink may be contained in the plurality of ink tanks 31. The different colors of inks may be, for example, black, yellow, magenta and cyan.

The ink tank 31 is configured to have a larger length dimension along the Y axis than a width dimension along the X axis. The ink tank 31 is also configured to have a smaller height dimension along the Z axis than the length dimension along the Y axis. The dimensions of the ink tank 31 are, however, not limited to this configuration, but any suitable dimensions may be employed for the ink tank 31. The ink tank 31 is configured to include a first wall 41, a second wall 42, a third wall 43, a fourth wall 44, a fifth wall 45, a sixth wall 46, a seventh wall 47 and an eighth wall 48. The ink tank 31 also includes a connection tube 49. The first wall 41 to the eighth wall 48 define an outer shell of the ink tank 31. The number of the walls defining the outer shell of the ink tank 31 is not limited to the eight walls of the first wall 41 to the eighth wall 48 but may be a number of walls less than eight or a number of walls greater than eight.

The first wall 41 is arranged to face in the +Y-axis direction and is extended along an XZ plane. The first wall 41 has optical transparency and is configured to cause the ink contained in the ink tank 31 to be visible through the first wall 41. The first wall 41 is accordingly provided as an observation wall that causes the amount of ink contained in the ink tank 31 to be observable. An upper limit mark 51 and a lower limit mark 52 are provided on the first wall 41. The operator can check the amount of ink contained in the ink tank 31 using the upper limit mark 51 and the lower limit mark 52 as guides or rough indications.

A sign or mark used to inform the amount of ink contained in the ink tank 31 is not limited to the upper limit mark 51 and the lower limit mark 52 but may be, for example, a scale indicating the amount of ink. According to a modification, a scale may be provided in addition to the upper limit mark 51 and the lower limit mark 52, or a scale may be provided with omission of the upper limit mark 51 and the lower limit mark 52. A sign or mark indicating the type of ink contained in each of the ink tanks 31 may also be provided in the ink tank 31. For example, the sign or mark indicating the type of ink may be a sign or mark indicating the color of ink. The sign or mark indicating the color of ink may be any of various indicators, for example, letters such as "Bk" indicating black ink, "C" indicating cyan ink, "M" indicating magenta ink and "Y" indicating yellow ink or color representation.

The second wall 42 is arranged to be opposed to the first wall 41 and to face in the −Y-axis direction. The second wall 42 is extended along the XZ plane. The third wall 43 is arranged to intersect with the first wall 41 and the second wall 42. The arrangement that two surfaces intersect with each other indicates the positional relationship that the two surfaces are not parallel to each other. The arrangement that two surfaces intersect with each other includes not only the arrangement that two surfaces are adjacent to each other and are directly in contact with each other but the arrangement that two surfaces are not directly in contact with each other but are away from each other and that an extension of one surface intersects with an extension of the other surface. The angle formed by the two surfaces intersecting with each other may be any of a right angle, an acute angle and an obtuse angle.

The third wall 43 is arranged to intersect with the first wall 41 and the second wall 42 as described above. The third wall 43 is located on a −Z-axis direction side of the first wall 41 and the second wall 42 and is arranged to face in the −Z-axis direction. The third wall 43 is extended along an XY plane. A +Y-axis direction end of the third wall 43 is connected with a −Z-axis direction end of the first wall 41. A −Y-axis direction end of the third wall 43 is connected with a −Z-axis direction end of the second wall 42.

The fourth wall 44 is arranged to be opposed to the third wall 43 and to face in the +Z-axis direction. The fourth wall 44 is arranged to intersect with the second wall 42 and is extended along the XY plane. The fourth wall 44 is located on a +Z-axis direction side of the second wall 42. The fourth wall 44 is located on a −Y-axis direction side of the first wall 41. A −Y-axis direction end of the fourth wall 44 is connected with a +Z-axis direction end of the second wall 42.

The fifth wall 45 is arranged to intersect with the first wall 41, the second wall 42, the third wall 43 and the fourth wall 44. The fifth wall 45 is located on a +X-axis direction side of the first wall 41, the second wall 42, the third wall 43 and the fourth wall 44. The fifth wall 45 is arranged to face in the +X-axis direction and is extended along a YZ plane. A +Y-axis direction end of the fifth wall 45 is connected with a +X-axis direction end of the first wall 41. A −Y-axis direction end of the fifth wall 45 is connected with a +X-axis direction end of the second wall 42. A −Z-axis direction end of the fifth wall 45 is connected with a +X-axis direction end of the third wall 43. A +Z-axis direction end of the fifth wall 45 is connected with a +X-axis direction end of the fourth wall 44.

The sixth wall 46 is arranged to intersect with the first wall 41, the second wall 42, the third wall 43 and the fourth wall 44. The sixth wall 46 is located on a −X-axis direction side of the first wall 41, the second wall 42, the third wall 43 and the fourth wall 44 and is arranged to be opposed to the fifth wall 45. The sixth wall 46 is arranged to face in the −X-axis direction and is extended along the YZ plane. A +Y-axis direction end of the sixth wall 46 is connected with a −X-axis direction end of the first wall 41. A −Y-axis direction end of the sixth wall 46 is connected with a −X-axis direction end of the second wall 42. A −Z-axis direction end of the sixth wall 46 is connected with a −X-axis direction end of the third wall 43. A +Z-axis direction end of the sixth wall 46 is connected with a −X-axis direction end of the fourth wall 44.

A seventh wall 47 is located on a +Z-axis direction side of the first wall 41 and is arranged to intersect with the first wall 41. The seventh wall 47 is arranged to face in the +Z-axis direction and is extended along the XY plane. The seventh wall 47 is located between the third wall 43 and the fourth wall 44. A +Y-axis direction end of the seventh wall 47 is connected with a +Z-axis direction end of the first wall 41. In other words, the ink tank 31 has a difference in level between the fourth wall 44 and the seventh wall 47. A +X-axis direction end of the seventh wall 47 is connected with a +Z-axis direction end of the fifth wall 45. A −X-axis direction end of the seventh wall 47 is connected with a +Z-axis direction end of the sixth wall 46.

The eighth wall 48 is located on a −Y-axis direction of the seventh wall 47 and is arranged to face in the +Y-axis direction. The eighth wall 48 is located on a +Y-axis direction side of the fourth wall 44. The eighth wall 48 is extended along the XZ plane. A −Z-axis direction end of the eighth wall 48 is connected with a −Y-axis direction end of the seventh wall 47. A +Z-axis direction end of the eighth wall 48 is connected with a +Y-axis direction end of the fourth wall 44. In other words, the fourth wall 44 and the seventh wall 47 having the level difference are connected with each other by the eighth wall 48 in the ink tank 31.

Figure 3:
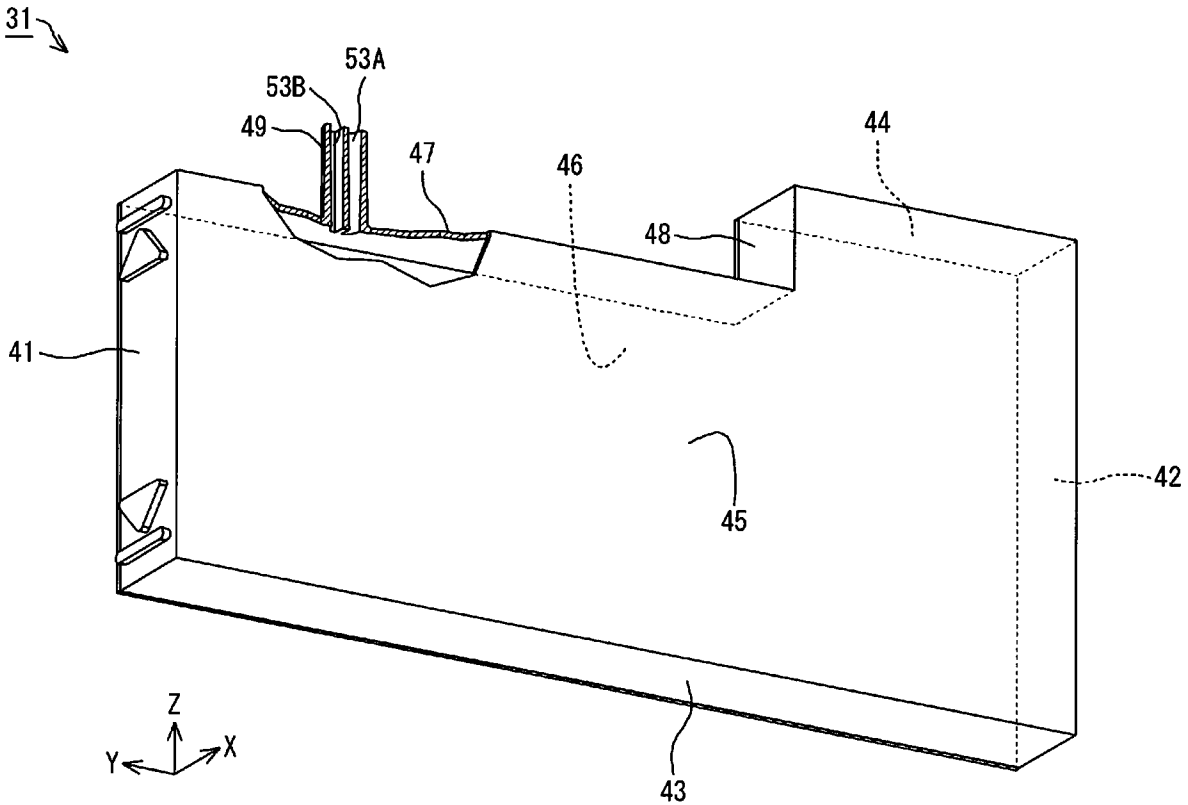
FIG. 3 is a perspective view illustrating an ink tank according to the embodiment.

A connection tube 49 as one example of a connection portion is provided on a +Z-axis direction side face of the seventh wall 47. The connection tube 49 is protruded in the +Z-axis direction from the seventh wall 47. The connection tube 49 is formed in a hollow tubular shape and is extended in the +Z-axis direction. In other words, the connection tube 49 is in a chimney-like form. The connection tube 49 is arranged to communicate with inside of the ink tank 31. Ink is injected into the ink tank 31 through the connection tube 49. As illustrated in FIG. 3, the inside of the connection tube 49 is divided along the Z axis into two flow paths 53A and 53B. The two flow paths 53A and 53B are respectively arranged to communicate with the inside of the ink tank 31. For the purpose of easy understanding of the inside of the connection tube 49, FIG. 3 is a partly cutaway diagram illustrating the ink tank 31 including the connection tube 49.

As illustrated in FIG. 2, the adapter 35 is configured to have a dimension extended across the plurality of ink tanks 31 arrayed along the X axis. The adapter 35 is located on a +Z-axis direction side of the seventh wall 47 of the ink tank 31. A plurality of slot portions 54 are formed in the adapter 35. The adapter 35 includes the slot portions 54 provided respectively corresponding to the plurality of ink tanks 31 arrayed along the X axis. The number of slot portions 54 may be larger than the number of the plurality of ink tanks 31 arrayed along the X axis.

The slot portion 54 is formed to be recessed in the −Z-axis direction from a +Z-axis direction-side upper surface of the adapter 35. A through hole 55 described later is formed in the bottom of the slot portion 54. This through hole 55 is formed to pass through the adapter 35 along the Z axis. The through hole 55 is formed to have such a size that allows for insertion of the connection tube 49 of the ink tank 31 therein. The adapter 35 is mounted to each level difference portion between the fourth wall 44 and the seventh wall 47 of each of the ink tanks 31. When the adapter 35 is mounted to the ink tanks 31, the connection tubes 49 of the respective ink tanks 31 are inserted through the through holes 55 into the slot portions 54 in the ink supply device 4. In the state that the adapter 35 is mounted to the ink tanks 31, the connection tubes 49 of the respective ink tanks 31 are accordingly exposed via the slot portions 54 of the adapter 35. The ink inlet 33 shown in FIG. 1 is a collective term including the slot portion 54 of the adapter 35 and the internal configuration of the slot portion 54 (including the connection tube 49) in the state that the adapter 35 is mounted to the ink tanks 31.

Figure 4:
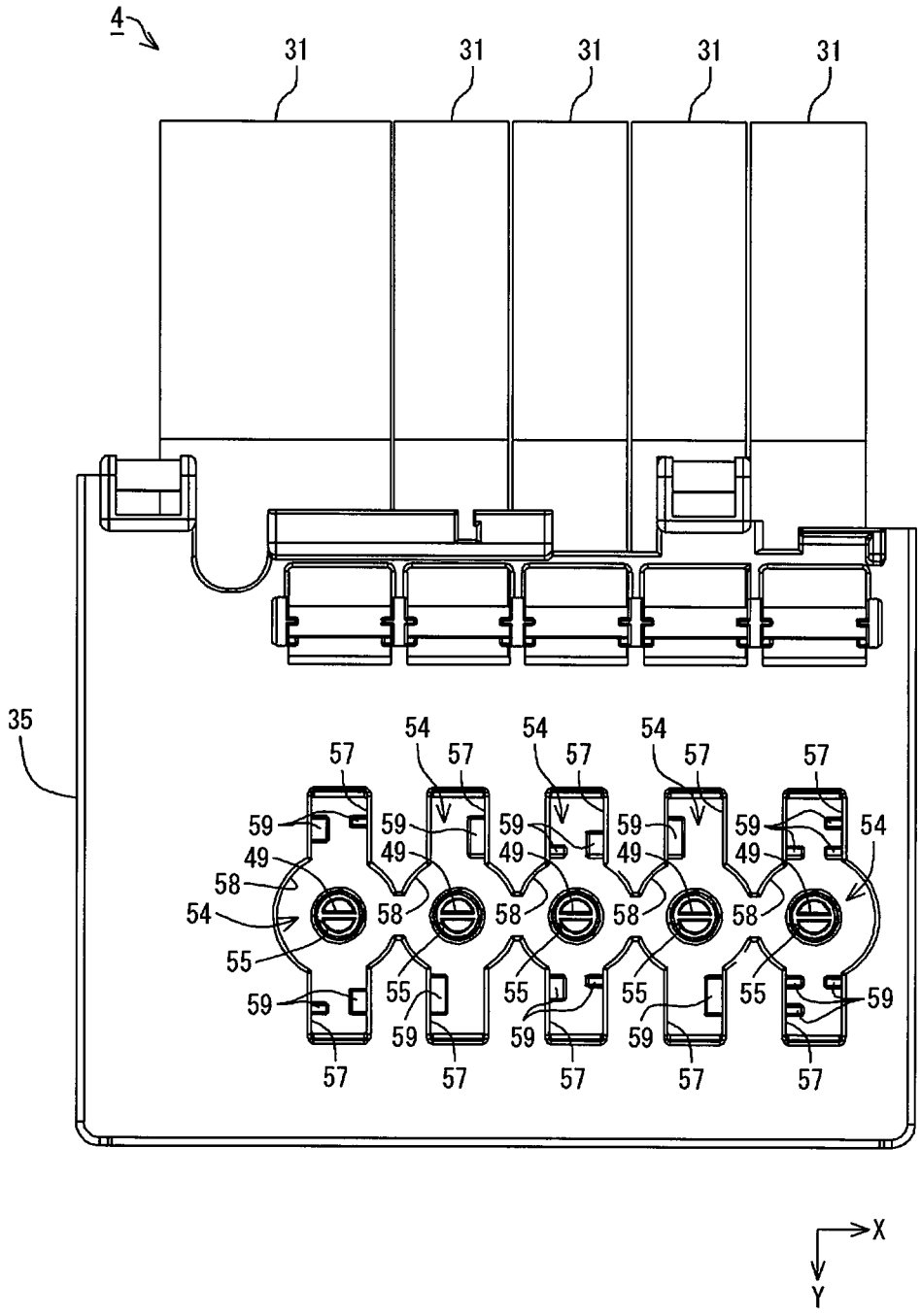
FIG. 4 is a plan view illustrating ink tanks and an adapter according to the embodiment.

As illustrated in FIG. 4, each of the slot portions 54 is formed in such an outer shape that rectangular portions 57 in a rectangular shape extended along the Y axis are arranged to overlap with a circular portion 58 in a circular shape located in the middle of the rectangular portions 57 along the Y axis. The through hole 55 is formed in the bottom of the circular portion 58. According to this embodiment, the circular portions 58 of the adjacent slot portions 54 that are adjacent to one another along the X axis are interconnected. The connection tube 49 of the ink tank 31 is located at a position overlapping with the through hole 55 of the circular portion 58.

First projections 59 are provided on inner walls extended along the YZ plane out of inner walls of the rectangular portions 57. The first projections 59 are provided in the rectangular portions 57 that are opposed to each other across the circular portion 58. In each of the slot portions 54, the first projections 59 are provided symmetrically with respect to a center point of the connection tube 49. Accordingly the slot portion 54 has a symmetrical configuration with respect to the center point of the connection tube 49. The plurality of slot portions 54 provided in the adapter 35 respectively include the first projections 59 of different configurations. Accordingly the plurality of slot portions 54 provided in the adapter 35 respectively have different configurations.

An ink bottle 62 described later, on the other hand, includes recesses that are provided corresponding to the configuration of each of the plurality of slot portions 54 provided in the adapter 35, such as to mate with the first projections 59 of the corresponding slot portion 54. This specifies the configuration of the ink bottle 62 mating with each of the plurality of slot portions 54 provided in the adapter 35. In other words, the plurality of slot portions 54 provided in the adapter 35 may serve as keyholes of respectively different configurations. The ink bottles 62 respectively mating with the plurality of slot portions 54 provided in the adapter 35 may serve as keys fit in the keyholes. Ink is allowed to be injected into the ink tank 31 through the connection tube 49 from the ink bottle 62 that is fit in the keyhole. On the contrary, ink is not allowed to be injected into the ink tank 31 from the ink bottle 62 that is not fit in the keyhole.

Figure 5:
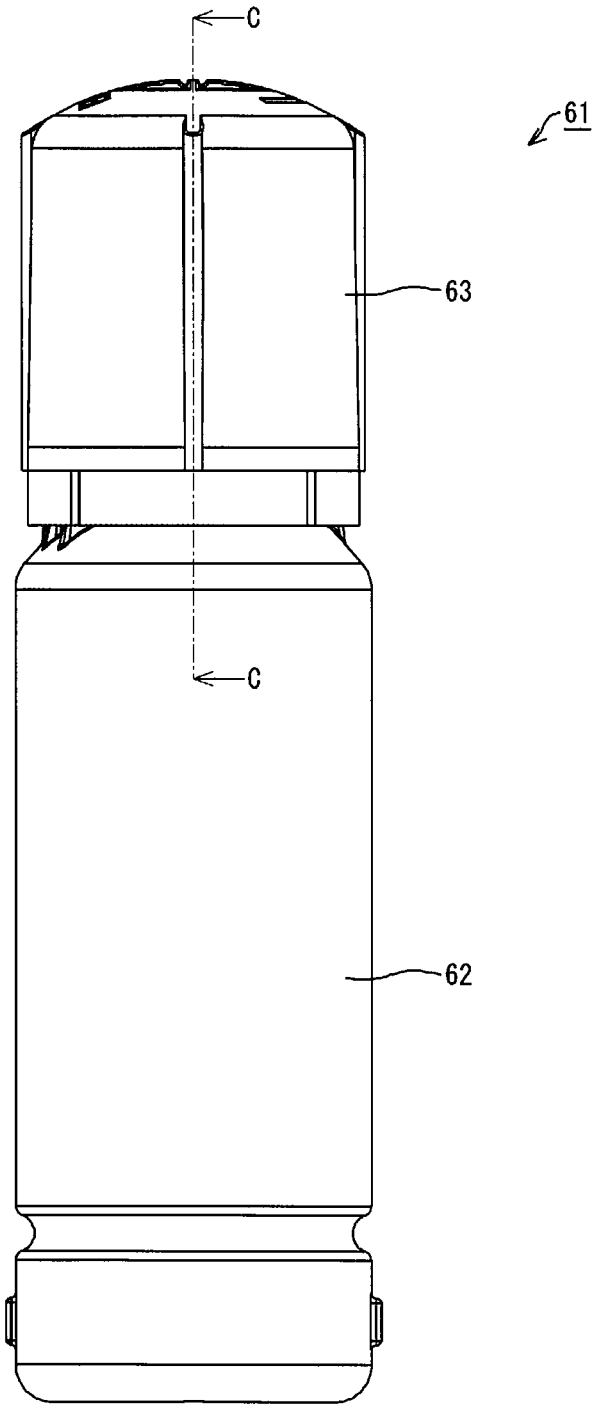
FIG. 5 is an appearance diagram illustrating a bottle set according to the embodiment.
Figure 6:
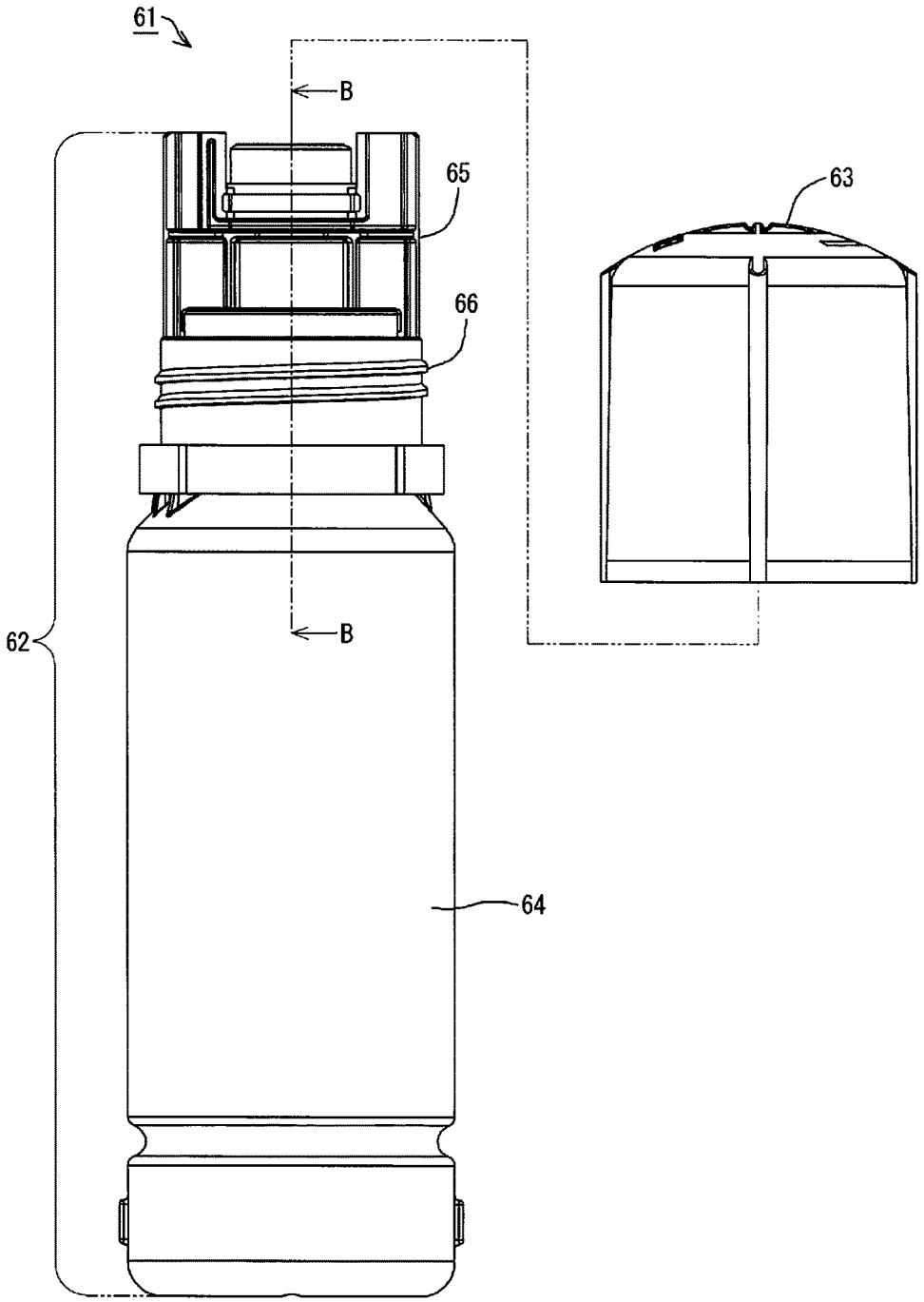
FIG. 6 is an exploded view illustrating the bottle set according to the embodiment.

According to this embodiment, a bottle set 61 shown in FIG. 5 may be used for injection of ink into the ink tank 31. Ink that is to be supplied to the ink tank 31 described above is contained in the bottle set 61. The bottle set 61 is configured to include the ink bottle 62 and a cover member 63. The cover member 63 is configured to be detachably mounted to the ink bottle 62 as shown in FIG. 6. The ink bottle 62 is configured to include an ink container portion 64 and an ink outlet forming portion 65. The ink container portion 64 is a portion that causes ink to be contained therein. The ink outlet forming portion 65 is a portion that causes the ink contained in the ink container portion 64 to be flowed out of the ink bottle 62.

The cover member 63 is configured to cover part of the ink outlet forming portion 65 when the cover member 63 is mounted to the ink bottle 62. An ink outlet 95 described later is formed in the ink outlet forming portion 65. The ink contained in the ink container portion 64 is flowed out of the ink bottle 62 through the ink outlet 95 provided in the ink outlet forming portion 65. The cover member 63 is configured to cover the ink outlet 95 provided in the ink outlet forming portion 65 when the cover member 63 is mounted to the ink bottle 62. With respect to the bottle set 61, the state that the cover member 63 is mounted to the ink bottle 62 (shown in FIG. 5) is called covered state. The covered state denotes the state that the cover member 63 is mounted to the ink bottle 62 such as to cover the ink outlet 95.

As shown in FIG. 6, the cover member 63 is configured to be engaged with the ink outlet forming portion 65 via threads 66 formed in the ink outlet forming portion 65. In other words, according to this embodiment, the cover member 63 is configured to be mounted to the ink bottle 62 by engagement via the threads 66. The cover member 63 includes threads (not shown) that are formed to be engageable with the threads 66 formed in the ink outlet forming portion 65. The cover member 63 is mounted to the ink bottle 62 by engagement of the threads in the cover member 63 with the threads 66 in the ink outlet forming portion 65.

Figure 7:
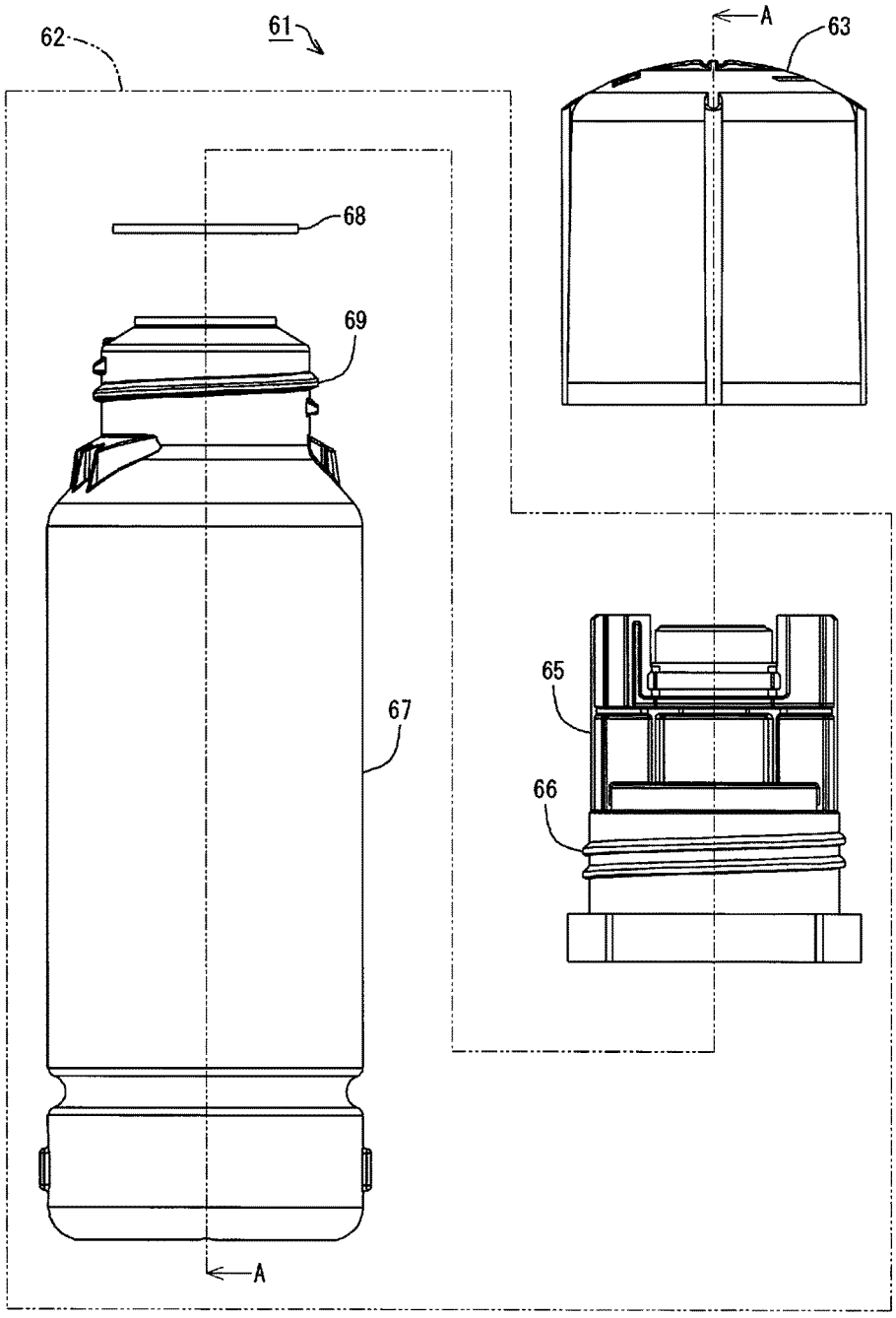
FIG. 7 is an exploded view illustrating an ink bottle according to the embodiment.

According to this embodiment, as shown in FIG. 7, the ink bottle 62 is configured to include a container main body 67, a seal member 68 and the ink outlet forming portion 65. The ink outlet forming portion 65 is provided on one end of the container main body 67. According to this embodiment, assembling the container main body 67 with the ink outlet forming portion 65 forms an outer shell of the ink bottle 62. The seal member 68 is placed between the container main body 67 and the ink outlet forming portion 65. The container main body 67 and the ink outlet forming portion 65 are assembled across the seal member 68 by engagement via threads 69 to be integrated as one ink bottle 62. The ink outlet forming portion 65 includes threads (described later) that are formed to be engageable with the threads 69 of the container main body 67. Engagement of the threads of the ink outlet forming portion 65 with the threads 69 of the container main body 67 assembles and integrates the container main body 67 and the ink outlet forming portion 65 as one ink bottle 62.

Figure 8:
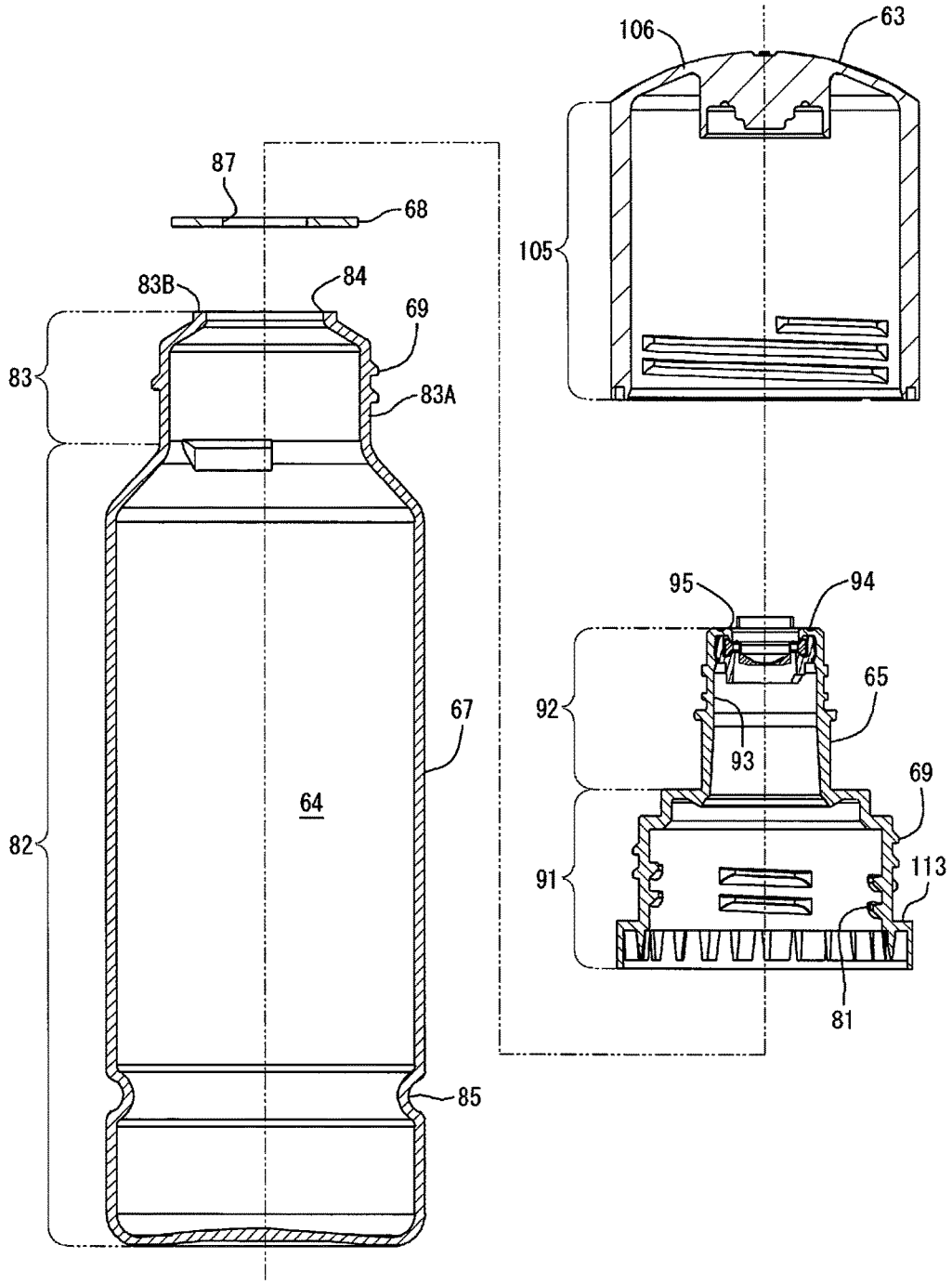
FIG. 8 is a sectional view taken on a line A-A in FIG. 7.

As shown in FIG. 8 that is a sectional view taken on a line A-A in FIG. 7, the container main body 67 is configured as a container to contain ink therein. The container main body 67 and the ink outlet forming portion 65 are configured as separate bodies. Threads 81 are formed in the ink outlet forming portion 65. The container main body 67 and the ink outlet forming portion 65 are configured to be engageable with each other via the threads 69 formed in the container main body 67 and the threads 81 formed in the ink outlet forming portion 65. The container main body 67 and the ink outlet forming portion 65 are also configured to be mountable to and demountable from each other. The ink outlet forming portion 65 is detached from the container main body 67 by twisting (turning) the ink outlet forming portion 65 relative to the container main body 67.

Ink is contained in the container main body 67. According to this embodiment, the container main body 67 is made of a material having elasticity. The container main body 67 is configured to include a tubular body portion 82, a tubular engagement portion 83 and an opening portion 84. The material usable for the container main body 67 may be, for example, a resin material such as polyethylene terephthalate (PET), nylon, polyethylene, polypropylene or polystyrene or a metal material such as iron material or aluminum. The body portion 82 and the engagement portion 83 are formed integrally with each other. The body portion 82 is located on an opposite side of the engagement portion 83 that is opposite to the seal member 68-side. The engagement portion 83 is located on the seal member 68-side of the body portion 82. The engagement portion 83 is formed to be smaller in diameter than the body portion 82. The threads 69 are formed in an outer side portion 83A of the engagement portion 83. The threads 69 are provided to be protruded from the side portion 83A. The opening portion 84 is formed on an opposite end 83B of the engagement portion 83 that is opposite to the body portion 82-side. The opening portion 84 is open toward the seal member 68-side.

The container main body 67 of the above configuration is formed as a hollow container including the body portion 82 and the engagement portion 83. The ink bottle 62 is configured to contain an amount of ink specified by the total volume of the body portion 82 and the engagement portion 83. In the ink bottle 62, the total inner space defined by the body portion 82 and the engagement portion 83 of the container main body 67 forms the ink container portion 64.

The container main body 67 also includes a second recess 85 that is formed in an outer circumferential part of the body portion 82. The second recess 85 of this embodiment corresponds to the second recess of the disclosure. The second recess 85 is formed to be recessed inward of the container main body 67. In other words, the second recess 85 is formed to be recessed toward the ink container portion 64 of the container main body 67. According to this embodiment, the second recess 85 is formed around the outer circumference of the body portion 82. This configuration causes the container main body 67 to be reinforced by the second recess 85. This configuration reduces deformation of the container main body 67 under application of, for example, a squeezing force to the container main body 67 and thereby suppresses the ink contained in the container main body 67 from leaking out through the ink outlet forming portion 65. The ink bottle 62 of this configuration accordingly has the enhanced convenience. The configuration of the second recess 85 is not limited to a curved sectional shape such as an arc shape but may be any of various shapes such as a rectangular shape or a V shape. The configuration of the second recess 85 is also not limited to the configuration that the second recess 85 is formed around the outer circumference of the body portion 82 but may be any of various configurations, for example, a configuration that the second recess 85 is formed intermittently around the outer circumference of the body portion 82, a configuration that the second recess 85 is formed in part of the outer circumference of the body portion 82 or a configuration that the second recess 85 is formed spirally on the outer circumference of the body portion 82.

An opening portion 87 is formed in the seal member 68. The ink contained in the container main body 67 is flowed through the opening 87 of the seal member 68 and is flowed out to the ink outlet forming portion 65. The seal member 68 is placed between the end 83B of the container main body 67 and the ink outlet forming portion 65. This configuration suppresses leakage of ink from between the container main body 67 and the ink outlet forming portion 65. The material usable for the seal member 68 may be any of various materials, for example, a foam material such as polyethylene or an elastic material such as a rubber or an elastomer.

As shown in FIG. 8, the ink outlet forming portion 65 is configured to include a joint portion 91 and a cylindrical portion 92. The joint portion 91 and the cylindrical portion 92 are formed integrally with each other. The material usable for the ink outlet forming portion 65 may be a resin material such as polyethylene terephthalate (PET), nylon, polyethylene, polypropylene or polystyrene. The joint portion 91 has a cylindrical outer shape. The threads 81 are formed on an inner side face of the joint portion 91. The joint portion 91 is a part that is engaged with the container main body 67 by means of the threads 81. The joint portion 91 is configured to have a larger inner diameter than the outer diameter of the engagement portion 83 of the container main body 67. The threads 81 are formed on the inner side of the joint portion 91, and the threads 69 are formed on the outer side of the engagement portion 83 of the container main body 67. The ink outlet forming portion 65 and the container main body 67 are engaged with each other by engagement of the threads 81 on the inner side of the joint portion 91 with the threads 69 on the outer side of the engagement portion 83. In the state that the ink outlet forming portion 65 is engaged with the container main body 67, the joint portion 91 of the ink outlet forming portion 65 covers the engagement portion 83 of the container main body 67.

Figure 9:
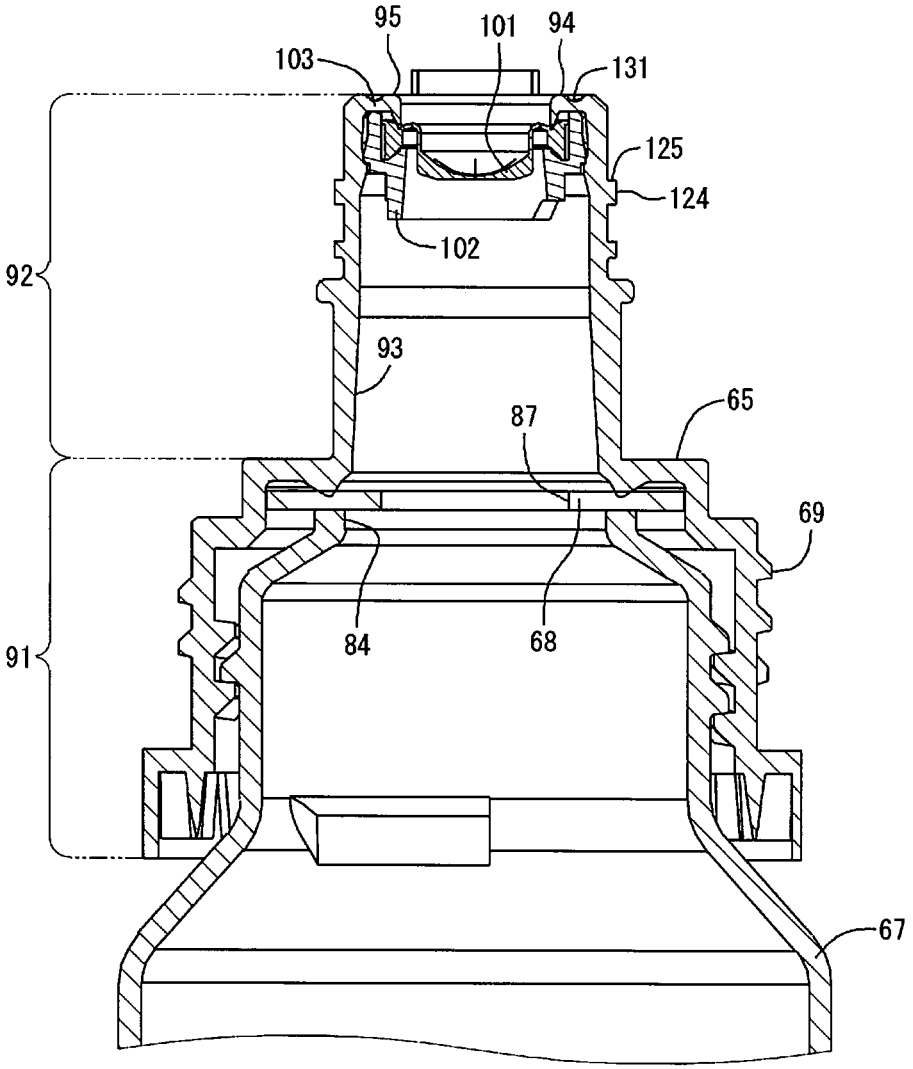
FIG. 9 is a sectional view taken on a line B-B in FIG. 6.

As shown in FIG. 9 that is a sectional view taken on a line B-B in FIG. 6, the cylindrical portion 92 is protruded from the joint portion 91 to an opposite side that is opposite to the container main body 67-side. The cylindrical portion 92 is in a cylindrical (tubular) form. A delivery passage 93 is formed inside of the cylindrical portion 92. The delivery passage 93 is provided in a region overlapping with the region of the opening portion 84 in the plan view of the ink outlet forming portion 65 in a direction from the opening portion 84-side toward the cylindrical portion 92-side. The delivery passage 93 is a hollow region in the cylindrical portion 92 that overlaps with the region of the opening portion 84 in the plan view.

An ink outlet 95 is formed on an end face 94 of the cylindrical portion 92 that is opposite to the joint portion 91-side, such as to cause the ink from the container main body 67 to flow out. The end face 94 is arranged to face to an opposite side that is opposite to the container main body 67-side. The ink outlet 95 is open toward an opposite side of the cylindrical portion 92 that is opposite to the joint portion 91-side. The ink outlet 95 is open in the end face 94. Accordingly the end face 94 is arranged to surround the ink outlet 95. The ink outlet 95 is located on a terminal end of the delivery passage 93.

The ink contained in the container main body 67 is flowed through the delivery passage 93 of the cylindrical portion 92 and is flowed out from the ink outlet 95. As a result, the ink contained in the container main body 67 is flowed from the opening portion 84 through the delivery passage 93 and the ink outlet 95 to be out of the container main body 67. When the user intends to inject the ink contained in the ink bottle 62 into the ink tank 31, the user inserts the ink outlet 95 into the ink inlet 33 of the ink tank 31. The user then injects the ink contained in the container main body 67 through the ink inlet 33 into the ink tank 31. When the user intends to inject the ink contained in the ink bottle 62 into the ink tank 31, the user detaches the cover member 63 (shown in FIG. 7) from the ink bottle 62 and then performs the ink injection.

As shown in FIG. 9, a valve 101 and a holder 102 are provided in the ink outlet forming portion 65. The valve 101 is configured to seal the ink outlet 95 in an openable and closable manner. In the ink outlet forming portion 65, the valve 101 is provided inside of the delivery passage 93 to seal the ink outlet 95 such as to open and close the ink outlet 95 relative to the delivery passage 93. The valve 101 is made of an elastic material such as a rubber or an elastomer and is configured to seal the ink outlet 95 under no application of an external force. When the connection tube 49 of the ink tank 31 is inserted into the ink outlet 95 to apply a pressing force (external force) to the valve 101, the valve 101 is opened. When the connection tube 49 is pulled out from the ink outlet 95 to release the external force applied to the valve 101, the valve 101 is closed.

Figure 10:
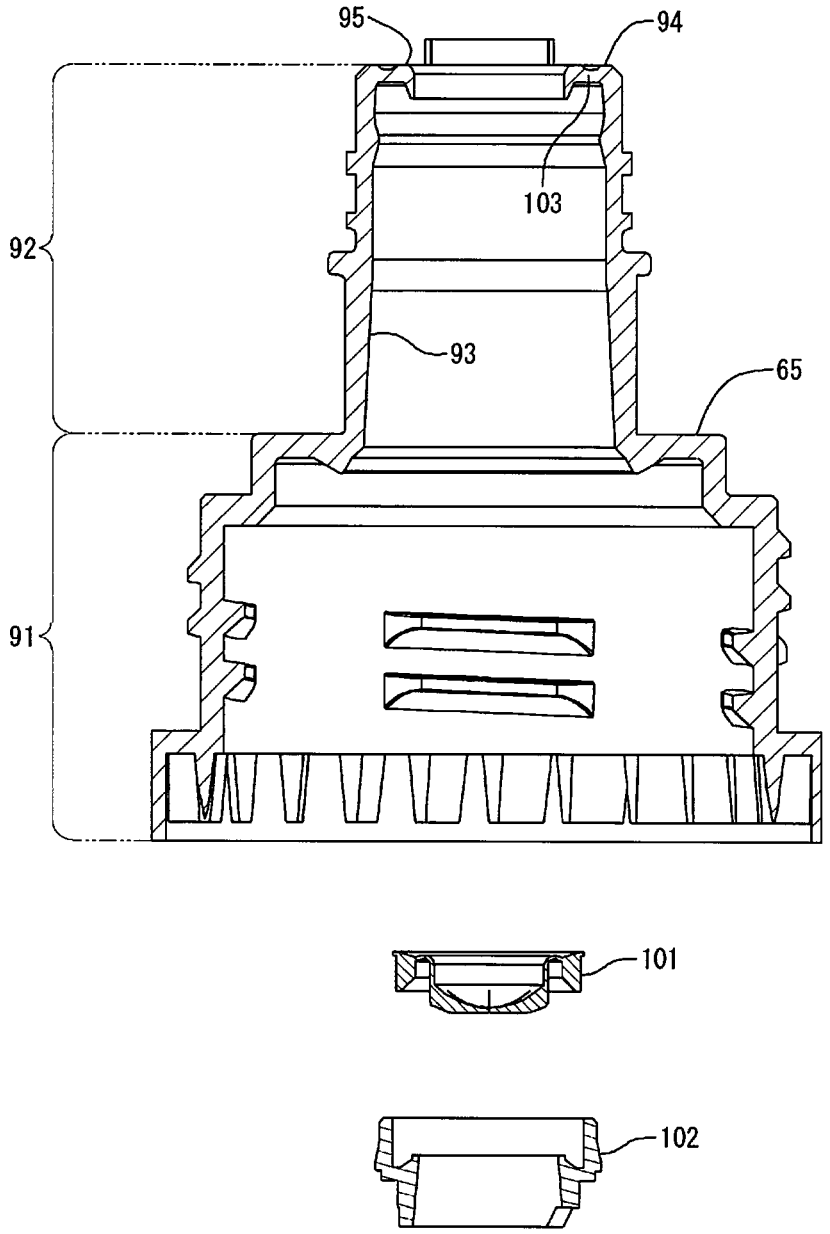
FIG. 10 is a sectional view illustrating an ink outlet forming portion, a valve and a holder according to the embodiment.

As shown in FIG. 10, the valve 101 and the holder 102 are configured to be separable from the ink outlet forming portion 65. In other words, the ink outlet forming portion 65, the valve 101 and the holder 102 are configured as separate bodies. The valve 101 is inserted from the joint portion 91-side of the ink outlet forming portion 65 into the delivery passage 93. The holder 102 is a member configured to suppress dropout of the valve 101 and is provided on the joint portion 91-side of the valve 101 as shown in FIG. 9. The holder 102 is also inserted from the joint portion 91-side of the ink outlet forming portion 65 into the delivery passage 93. The valve 101 is placed between the holder 102 and a flange portion 103 of the ink outlet forming portion 65. The ink outlet forming portion 65, the valve 101 and the holder 102 are accordingly assembled and integrated. The flange portion 103 is a wall that is extended inward in the radial direction of the cylindrical portion 92 from an inner side face of the cylindrical portion 92. An opposite side face of the flange portion 103 that is opposite to the joint portion 91-side corresponds to the end face 94.

Figure 11:
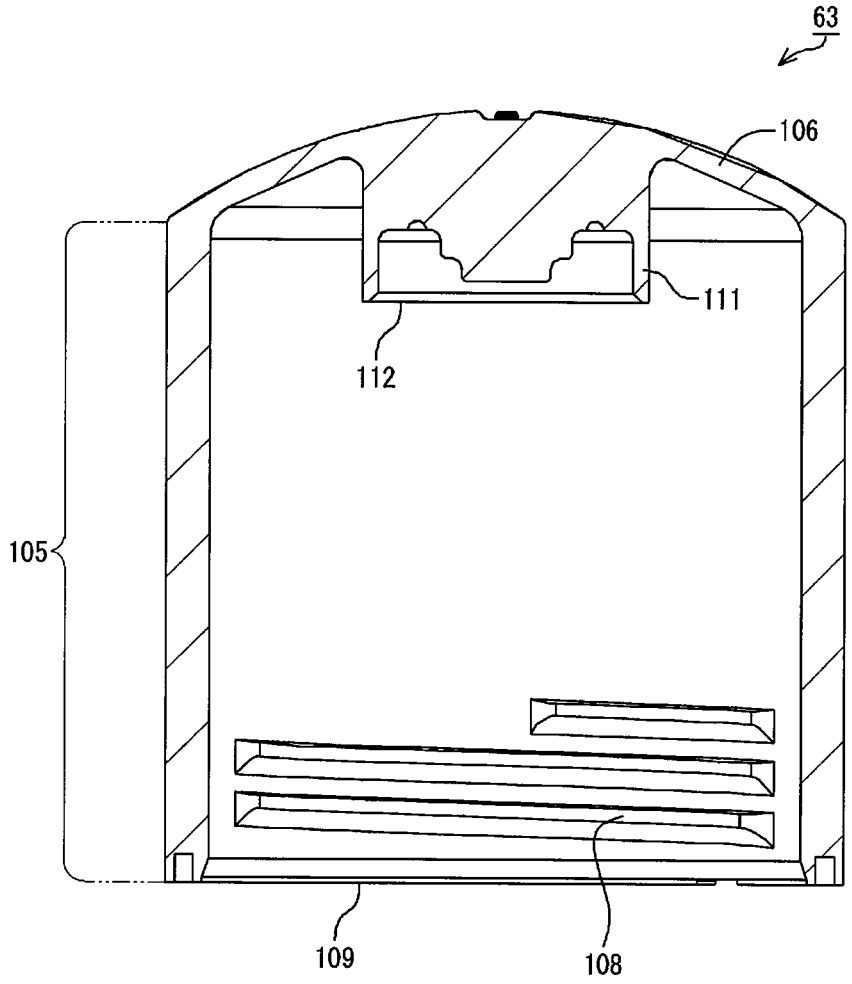
FIG. 11 is a diagram illustrating close-up of a cover member shown in FIG. 8.

The cover member 63 is made of a material having elasticity and is configured to include a tubular body portion 105 and a top board portion 106 as shown in FIG. 11 that is a diagram illustrating close-up of the cover member 63 shown in FIG. 8. The material usable for the cover member 63 may be, for example, a resin material such as polyethylene terephthalate (PET), nylon, polyethylene, polypropylene or polystyrene. According to this embodiment, the cover member 63 is formed by injection molding of the resin material.

The body portion 105 and the top board portion 106 are formed integrally with each other. As shown in FIG. 8, in the bottle set 61, the body portion 105 of the cover member 63 is located on the ink outlet forming portion 65-side. As shown in FIG. 11, the top board portion 106 is located on one end of the body portion 105. According to this embodiment, the top board portion 106 is located on an opposite side of the body portion 105 that is opposite to the ink outlet forming portion 65-side. The tubular body portion 105 is protruded from the top board portion 106 toward the ink container portion 64 (shown in FIG. 8). The top board portion 106 is configured to close one end of the tubular body portion 105. In other words, a member provided to close one end of the tubular body portion 105 is the top board portion 106. An opening may be formed in the top board portion 106. Even in such a configuration with an opening, since the top board portion 106 is extended in a direction intersecting with the tubular body portion 105, it is regarded that the top board portion 106 closes one end of the tubular body portion 105.

In the illustrated example of FIG. 11, the top board portion 106 is configured by a curved plate. The top board portion 106 may, however, be configured by any of various plates such as a flat plate, a plate with concaves and convexes or a corrugated plate. The top board portion 106 is not restricted in a plate-like shape but may be in any of various shapes, such as a spherical shape, a columnar shape or a cone shape. A member in any shape configured to close one end of the tubular body portion 105 corresponds to the top board portion 106.

Threads 108 are provided in an inner side face of the body portion 105. The body portion 105 is a portion that is to be engaged with the ink outlet forming portion 65 (shown in FIG. 9) by means of the threads 108. The threads 108 are provided at a position nearer to an end 109 of the body portion 105 than the top board portion 106. The threads 108 are formed on an inner side of the body portion 105, and the threads 69 are formed on an outer side of the joint portion 91 of the ink outlet forming portion 65. The cover member 63 and the ink outlet forming portion 65 are engaged with each other by engagement of the threads 108 on the inner side of the body portion 105 with the threads 69 on the outer side of the joint portion 91 of the ink outlet forming portion 65. In the state that the cover member 63 is engaged with the ink outlet forming portion 65, the cover member 63 covers the cylindrical portion 92 of the ink outlet forming portion 65. In other words, the covered state is the state that the cover member 63 is engaged with the ink outlet forming portion 65.

As shown in FIG. 11, a plug element 111 is provided in the top board portion 106 of the cover member 63. The plug element 111 is provided on the ink outlet forming portion 65-side (shown in FIG. 8) of the top board portion 106, i.e., on the end 109-side of the top board portion 106. The plug element 111 is protruded from the top board portion 106 toward the end 109-side. The plug element 111 is provided in a center region of the top board portion 106. The plug element 111 is provided at a position opposed to (facing) the ink outlet 95 of the cylindrical portion 92 when the cover member 63 is mounted to the ink bottle 62. The plug element 111 has a tubular outer shape.

Figure 12:
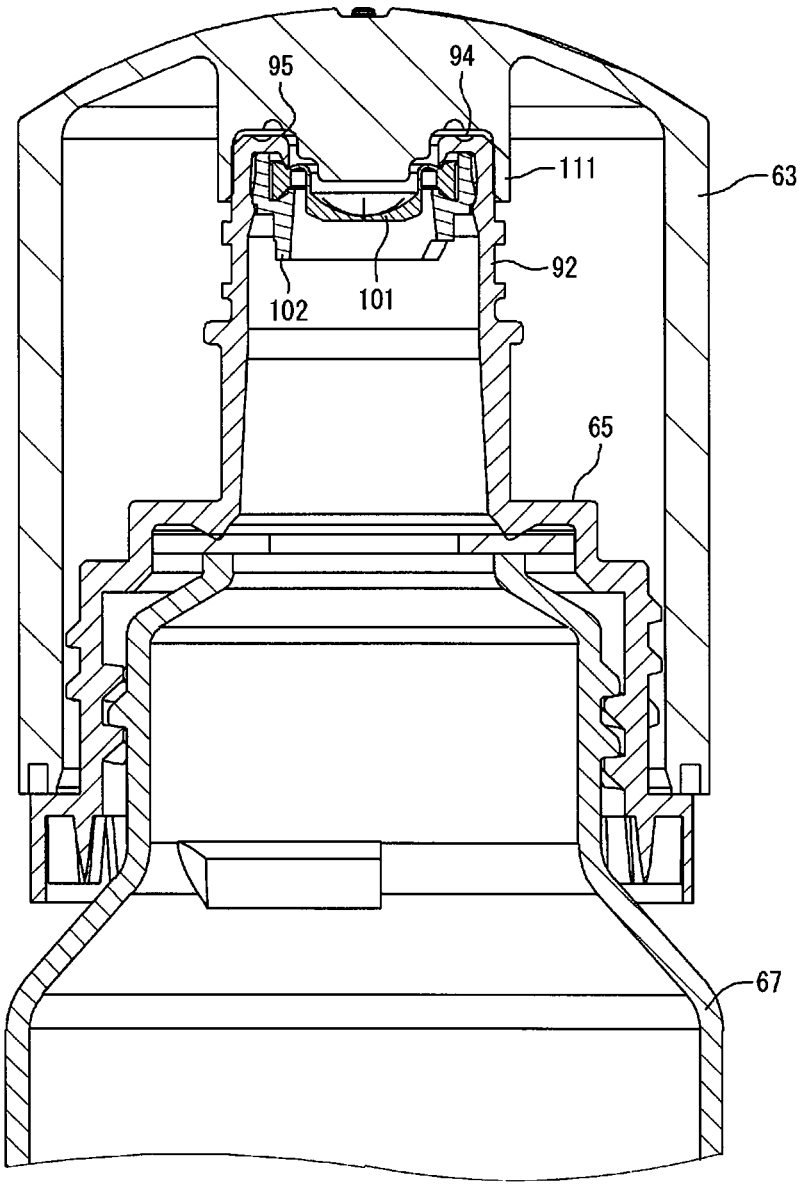
FIG. 12 is a sectional view taken on a line C-C in FIG. 5.

According to this embodiment, as shown in FIG. 11, the distance (depth) from the end 109 of the body portion 105 to an end 112 of the plug element 111 is shorter (shallower) than the distance from an end 113 of the joint portion 91 of the ink outlet forming portion 65 (shown in FIG. 8) to the end face 94 of the cylindrical portion 92. As shown in FIG. 12 that is a sectional view taken on a line C-C in FIG. 5, when the cover member 63 is mounted to the ink bottle 62, the plug element 111 covers the end face 94 from outside of the cylindrical portion 92. The inner diameter of the tubular plug element 111 is slightly smaller than the outer diameter of an end face 94-side end of the cylindrical portion 92. This configuration causes the ink outlet 95 of the ink outlet forming portion 65 to be sealed by the plug element 111 when the cover member 63 is mounted to the ink outlet forming portion 65. The cover member 63 is configured not to be in contact with an inner diameter portion of the ink outlet 95 in this state. The cover member 63 is also configured not to be in contact with the valve 101 in this state.

This configuration enables the ink outlet 95 to be sealed. When the ink contained in the container main body 67 is not fully injected into the ink tank 31 but remains in the container main body 67, this configuration enables the ink to be stored in the ink bottle 62 in the state that the ink outlet 95 is closed by the cover member 63. This configuration accordingly enables ink to be stored with the enhanced airtightness in the container main body 67 after opening. As a result, this configuration suppresses vaporization of the liquid component of ink contained in the ink bottle 62 and degradation of the ink.

As described above, in the ink bottle 62, the valve 101 is provided in the ink outlet forming portion 65 to seal the ink outlet 95 in an openable and closable manner. The valve 101 accordingly serves to suppress leakage of the ink contained in the container main body 67 from the ink outlet 95, for example, even when the ink bottle 62 is inclined with the ink outlet 95 facing down after detachment of the cover member 63 from the ink bottle 62. The valve 101 also serves to suppress leakage of the ink contained in the container main body 67 from the ink outlet 95, for example, even when the ink bottle 62 is swung during conveyance of the ink bottle 62 after detachment of the cover member 63 from the ink bottle 62.

Figure 13:
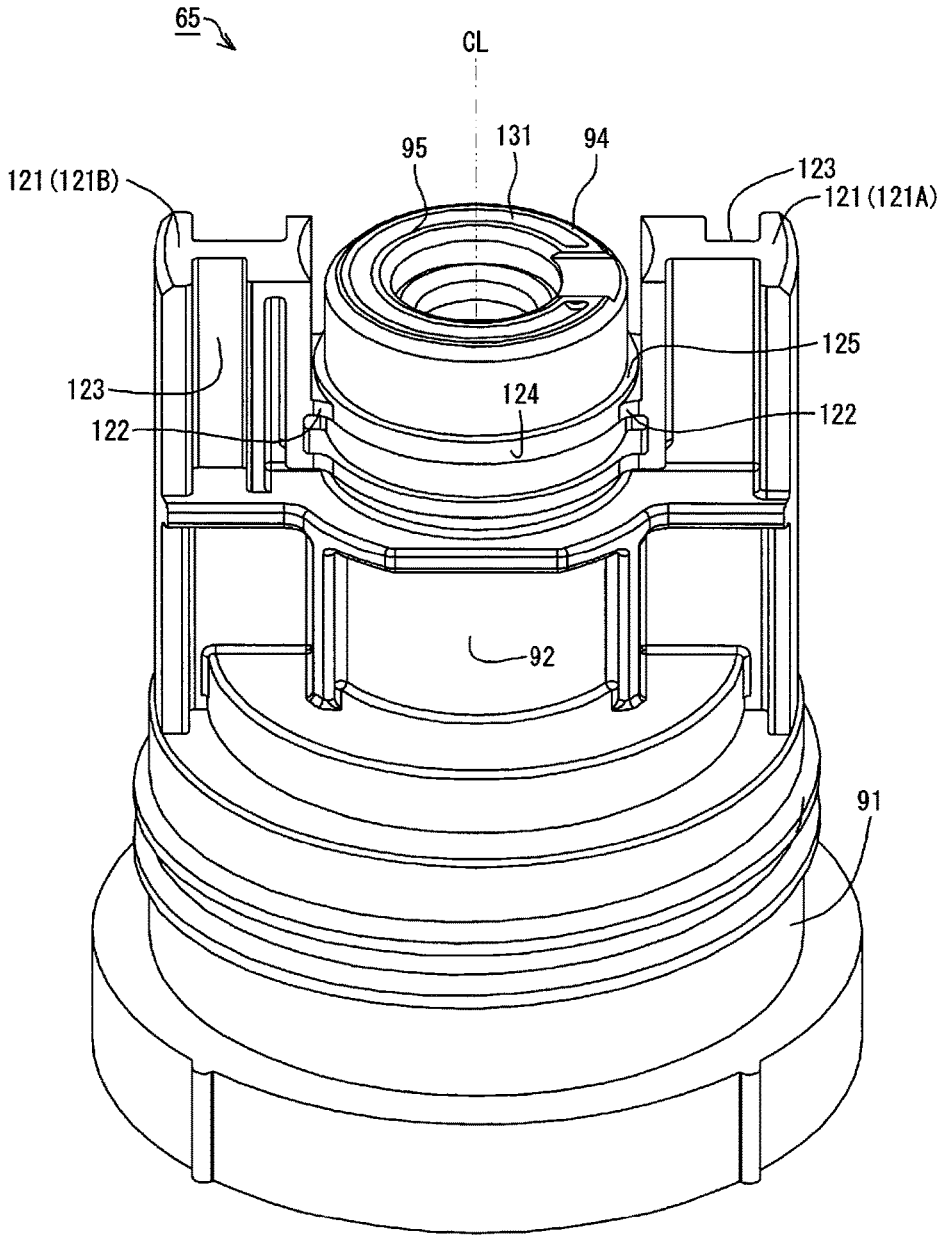
FIG. 13 is a perspective view illustrating the ink outlet forming portion according to the embodiment.

A plurality of (two in this embodiment) positioning elements 121 are provided in the ink outlet forming portion 65 as shown in FIG. 13. In the description below, when the two positioning elements 121 are to be distinguished from each other, the two positioning elements 121 are expressed as positioning element 121A and positioning element 121B. The positioning element 121A and the positioning element 121B are located outside of the cylindrical portion 92 in the plan view of the ink outlet forming portion 65 in a direction from the cylindrical portion 92 toward the joint portion 91.

In the ink outlet forming portion 65, the positioning element 121A and the positioning element 121B are provided in the joint portion 91. The positioning element 121A and the positioning element 121B are provided at positions opposed to each other across the cylindrical portion 92 in the plan view of the ink outlet forming portion 65 in the direction from the cylindrical portion 92 toward the joint portion 91. The positioning element 121A and the positioning element 121B are protruded from the joint portion 91 toward the end face 94. Each of the positioning element 121A and the positioning element 121B is joined with the cylindrical portion 92 via a coupling element 122. The coupling element 122 corresponds to the coupling element described in Aspect 4 in SUMMARY.

The positioning element 121A and the positioning element 121B are configured to include third recesses 123. The third recesses 123 are configured to be engaged with the first projections 59 formed in each of the slot portions 54 of the adapter 35 of the ink supply device 4 (shown in FIG. 4). The first projections 59 of the slot portion 54 are fit in the third recesses 123 of the positioning elements 121, so that the ink outlet forming portion 65 is inserted in the slot portion 54. As described above, the first projections 59 are arranged symmetrically with respect to the center point of the connection tube 49 in each of the slot portions 54. The positioning element 121A and the positioning element 121B are arranged symmetrically with respect to a center axis CL of the ink outlet 95 in the plan view of the ink outlet forming portion 65 in the direction from the cylindrical portion 92 toward the joint portion 91. The positioning element 121A and the positioning element 121B are formed at equal intervals of a phase angle of 180 degrees with respect to the center axis CL of the ink outlet 95. The center axis CL is an axis that perpendicularly passes through the center of a region surrounded by the periphery of the ink outlet 95 in the plan view of the ink outlet forming portion 65 in the direction from the cylindrical portion 92 toward the joint portion 91.

A second projection 124 is formed on an outer wall of the cylindrical portion 92. The second projection 124 is provided continuously around the outer circumference of the cylindrical portion 92. There is accordingly a difference in level between the outer circumference of the cylindrical portion 92 and the second projection 124. A wall 125 is accordingly provided between the outer circumference of the cylindrical portion 92 and the second projection 124 to connect the level difference between the outer wall of the cylindrical portion 92 and the second projection 124. The wall 125 is arranged to face in a direction from the joint portion 91 toward the cylindrical portion 92. A portion located nearest to the end face 94-side in the coupling element 122 configured to join the positioning element 121 with the cylindrical portion 92 is provided at a position farther from the ink outlet 95 than the wall 125 in an axial direction of the center axis CL.

A first recess 131 is formed in an outer side of the ink outlet 95 on the end face 94 of the cylindrical portion 92. The first recess 131 of this embodiment corresponds to the first recess of the present disclosure. As shown in FIG. 9, the first recess 131 is formed such as to be recessed toward the container main body 67. The first recess 131 is thus likely to block the ink dripping from the ink outlet 95 onto the end face 94. This configuration is likely to prevent the ink dripping from the ink outlet 95 onto the end face 94 from being diffused toward the container main body 67-side. The ink bottle 62 of this configuration accordingly has the enhanced convenience.

As described above, the second projection 124 is formed on the outer wall of the cylindrical portion 92. This configuration forms the level difference between the outer wall of the cylindrical portion 92 and the second projection 124, so that the wall 125 connecting the level difference is likely to block the ink. This configuration is likely to prevent the ink dripping from the ink outlet 95 onto the cylindrical portion 92 from being diffused toward the container main body 67-side. The ink bottle 62 of this configuration accordingly has the enhanced convenience.

As shown in FIG. 13, the portion of the coupling element 122 located nearest to the end face 94-side is provided at the position farther from the ink outlet 95 than the wall 125 in the axial direction of the center axis CL. In other words, the level difference formed in the cylindrical portion 92 is provided at a position nearer to the ink outlet 95 than the coupling element 122. The wall 125 is thus likely to block the ink dripping from the ink outlet 95 onto the cylindrical portion 92 before reaching the coupling element 122. As a result, the ink dripping from the ink outlet 95 onto the cylindrical portion 92 is less likely to reach the coupling element 122. This configuration is thus likely to prevent diffusion of ink toward the positioning elements 121-side.

Figure 14:
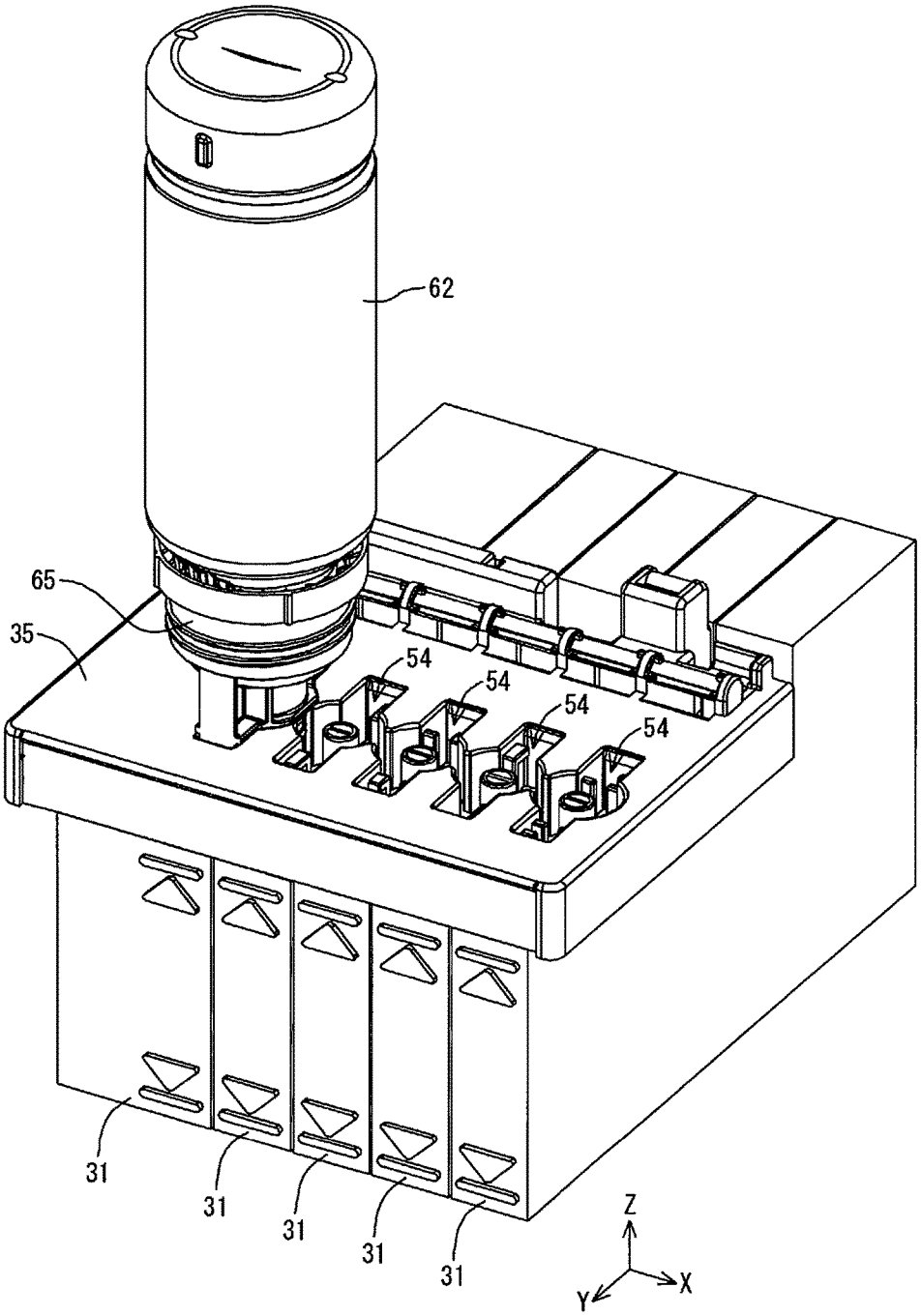
FIG. 14 is a perspective view illustrating the ink bottle and the ink supply device according to the embodiment.
Figure 15:
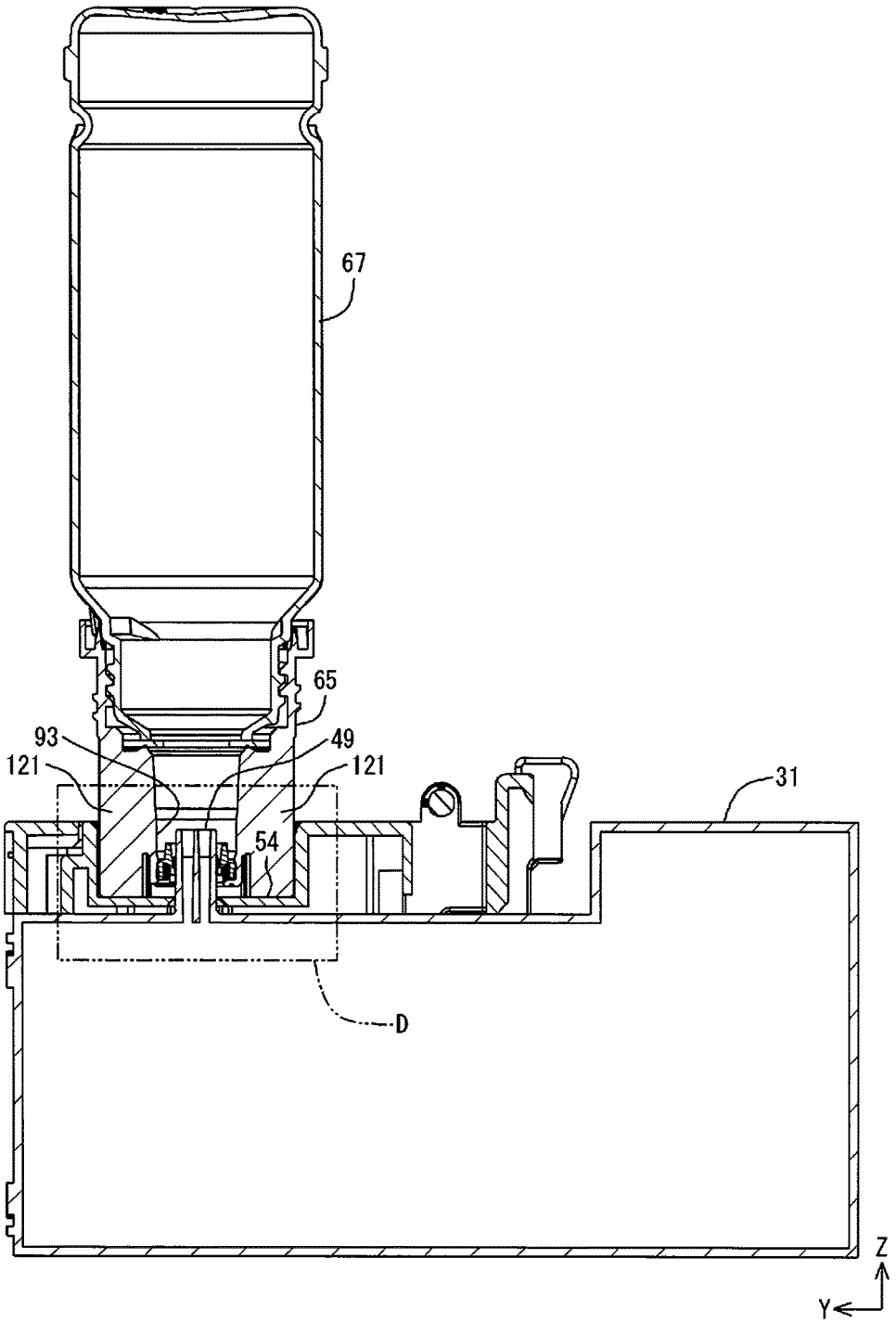
FIG. 15 is a sectional view illustrating the ink bottle and the ink supply device according to the embodiment.
Figure 16:
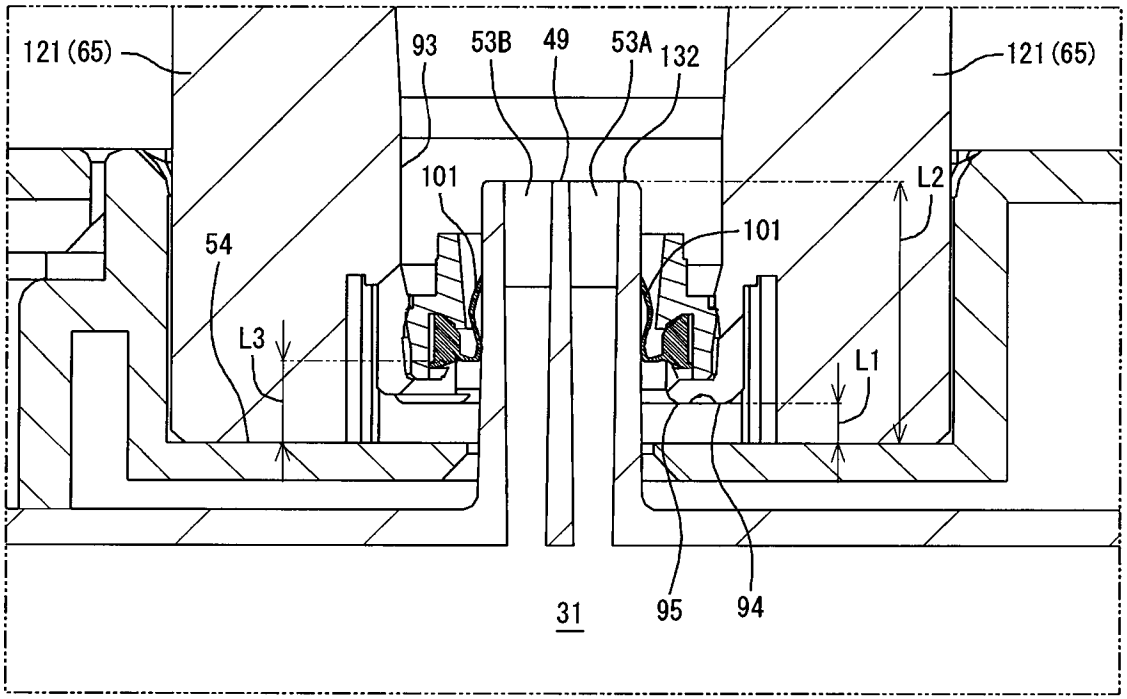
FIG. 16 is an enlarged view illustrating a region D of FIG. 15.

As shown in FIG. 14, the first projections 59 of the slot portion 54 in the adapter 35 of the ink supply device 4 (shown in FIG. 4) are fit in the third recesses 123 of the positioning elements 121, so that the ink outlet forming portion 65 of the ink bottle 62 is inserted in the slot portion 54. In this state, the connection tube 49 of the ink tank 31 is inserted into the delivery passage 93 of the ink outlet forming portion 65 as shown in the sectional view of FIG. 15. FIG. 15 illustrates a section of the ink tank 31 and the ink bottle 62 shown in FIG. 14, taken along a YZ plane. In this state, the valve 101 is opened by the connection tube 49 as shown in FIG. 16 that is an enlarged view of a region D shown in FIG. 15.

In the state that the positioning elements 121 of the ink outlet forming portion 65 hit against the bottom of the slot portion 54, a distance L1 from the bottom of the slot portion 54 to the end face 94 and a distance L2 from the bottom of the slot portion 54 to a leading end 132 of the connection tube 49 satisfy the relationship of Expression (1) given below:

$$L1<L2 \quad (1)$$

According to the relationship of Expression (1) given above, the leading end 132 of the connection tube 49 moves through the ink outlet 95 into the delivery passage 93 in the state that the ink outlet forming portion 65 hits against the bottom of the slot portion 54. Accordingly the connection tube 49 is connected with the ink outlet 95 in the state that the ink outlet forming portion 65 hits against the bottom of the slot portion 54. In the ink tank 31, the connection tube 49 is provided to be connectable with the ink outlet 95.

A distance L3 from the bottom of the slot portion 54, the distance L1 and the distance L2 satisfy the relationship of Expression (2) given below:

$$L1<L3<L2 \quad (2)$$

According to the relationship of Expression (2) given above, the valve 101 is opened by the connection tube 49 in the state that the positioning elements 121 of the ink outlet forming portion 65 hit against the bottom of the slot portion 54. According to the above relationship, the positioning elements 121 specify the position of the valve 101 relative to the ink tank 31 in the state that the ink outlet 95 is connected with the connection tube 49 and that the valve 101 is opened.

This configuration causes the delivery passage 93 to communicate with inside of the ink tank 31 via the flow path 53A and the flow path 53B of the connection tube 49. This configuration accordingly causes the ink contained in the ink bottle 62 to be injected through the connection tube 49 into the ink tank 31. As described above, the inside of the connection tube 49 is divided into the two flow paths 53A and 53B. This configuration enables the ink contained in the ink bottle 62 to be flowed through one of the two flow paths 53A and 53B into the ink tank 31, while enabling the air present in the ink tank 31 to be flowed through the other of the two flow paths 53A and 53B into the ink bottle 62. This configuration accordingly accelerates exchange between the ink contained in the ink bottle 62 and the air present in the ink tank 31 (gas liquid exchange) via the connection tube 49 that is divided into the two flow paths 53A and 53B. As a result, the configuration of this embodiment enables the ink to be promptly injected from the ink bottle 62 into the ink tank 31 and accordingly has the enhanced convenience.

According to this embodiment, a translucent white material is employed for the connection tube 49 of the ink tank 31 and for the ink outlet forming portion 65 of the bottle set 61, and a transparent material is employed for the cover member 63 of the bottle set 61. The transparent cover member 63 and the translucent ink outlet forming portion 65 enables the absence of an ink stain to be readily checked. In other words, this configuration improves the visibility and enables the operator to readily find any ink stain on the cover member 63 or the ink outlet forming portion 65 and quickly take a necessary action, for example, wipe out the ink stain on these members. Employing the translucent white material for the ink outlet forming portion 65 enables the operator to check the color of ink (contained in the ink bottle 62) via the ink outlet forming portion 65 even when the operator holds the ink bottle 62. This configuration thus further reduces the possibility that any wrong color of ink is injected into the ink tank 31 that is provided to contain a different color of ink (from the color of ink contained in the ink bottle 62). While the translucent white material is employed for the connection tube 49, a different color material from the translucent white material is employed for the peripheral structure of the connection tube 49, for example, the adapter 35. This configuration enables the connection tube 49 to be readily distinguished from the peripheral structure of the connection tube 49 and makes it easier to guide the ink outlet 95 of the ink bottle 62 to the connection tube 49.

According to a modification, a gray color material that makes an ink stain unnoticeable may be employed for the connection tube 49, the cover member 63 and the ink outlet forming portion 65. The gray color material that makes an ink stain unnoticeable may also be employed for the other peripheral structure. According to another modification, another color that makes an ink stain unnoticeable, for example, an opposite color to the color of ink, may be employed for the connection tube 49, the cover member 63 and the ink outlet forming portion 65. The opposite color to the color of ink denotes a color of a hue angle by adding 180 degrees to the hue angle of the color of ink in a chromaticity diagram of Lab color system. The coloring for the connection tube 49, the cover member 63 and the ink outlet forming portion 65 may similarly be employed in modifications described below.

[Modification 1]

Figure 17:
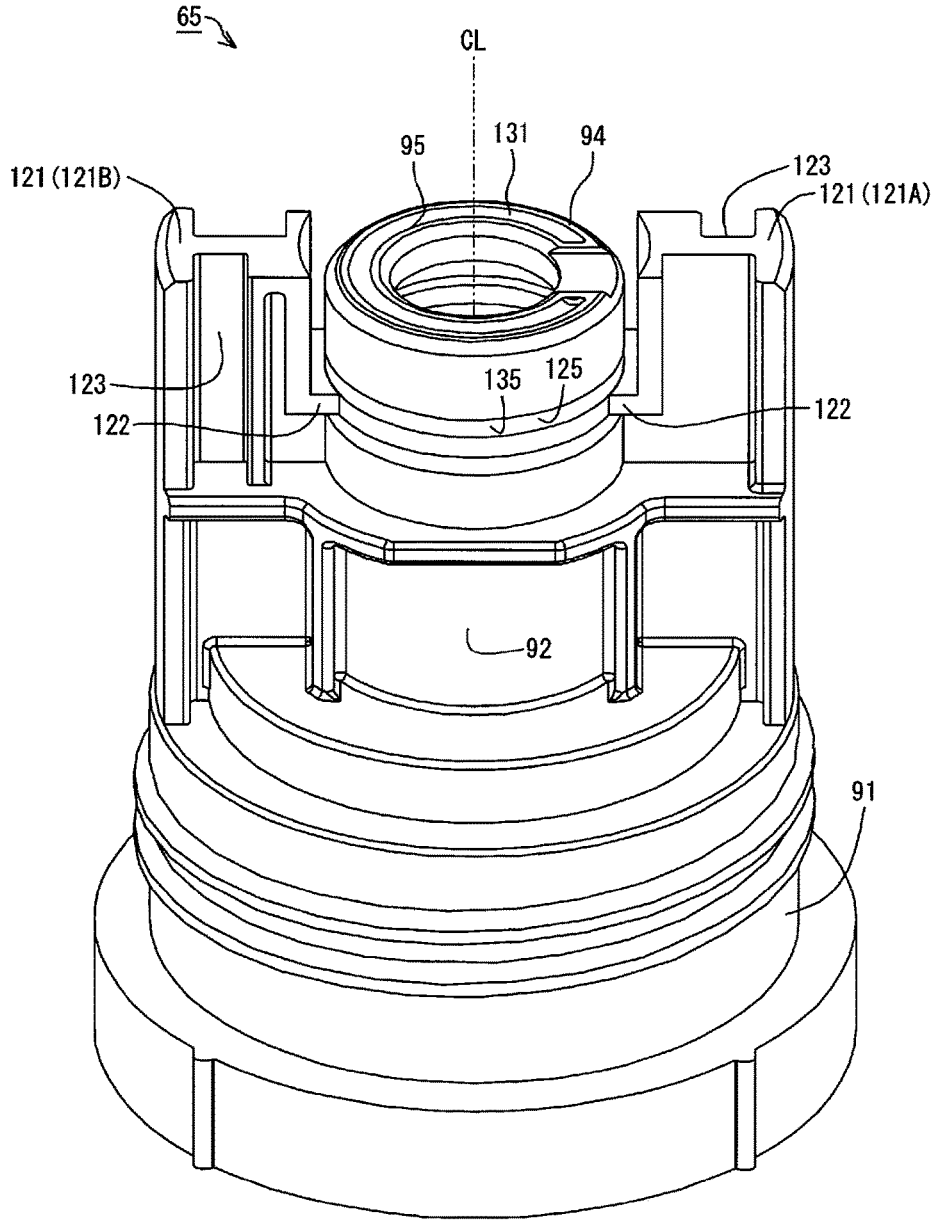
FIG. 17 is a perspective view illustrating an ink outlet forming portion according to Modification 1.

According to the above embodiment, the second projection 124 is formed on the outer wall of the cylindrical portion 92 in the ink outlet forming portion 65, so that the level difference is formed between the cylindrical portion 92 and the second projection 124 as shown in FIG. 13. The configuration of the level difference is, however, not limited to the configuration of this embodiment. According to a modification, a fourth recess 135 may be formed in the outer wall of the cylindrical portion 92, so that a level difference may be formed between the cylindrical portion 92 and the fourth recess 135, as shown in FIG. 17. The coupling element 122 is provided at a position farther from the ink outlet 95 than the level difference (between the cylindrical portion 92 and the fourth recess 135) in the axial direction of the center axis CL of the ink outlet 95. The configuration of this Modification 1 provides similar advantageous effects to those of the above embodiment.

[Modification 2]

Figure 18:
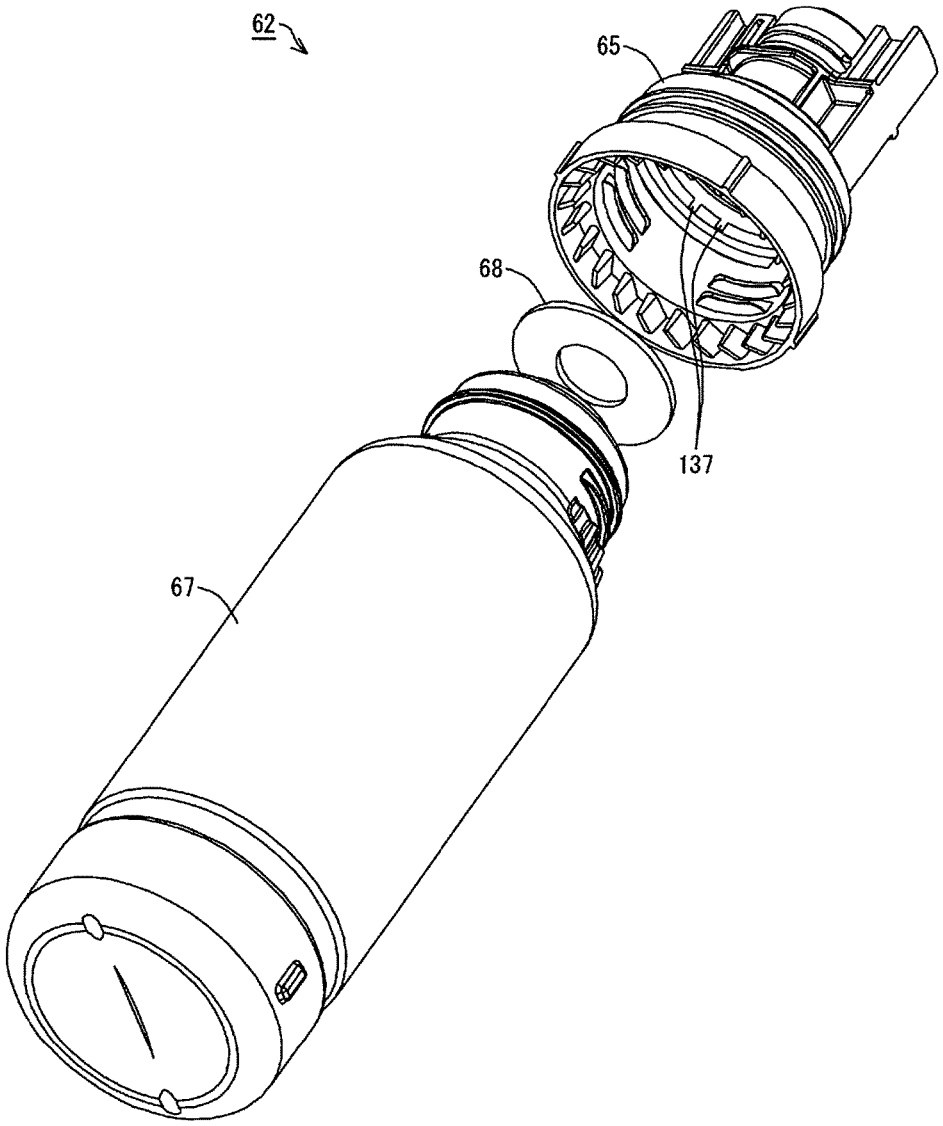
FIG. 18 is an exploded perspective view illustrating an ink bottle according to Modification 2.
Figure 19:
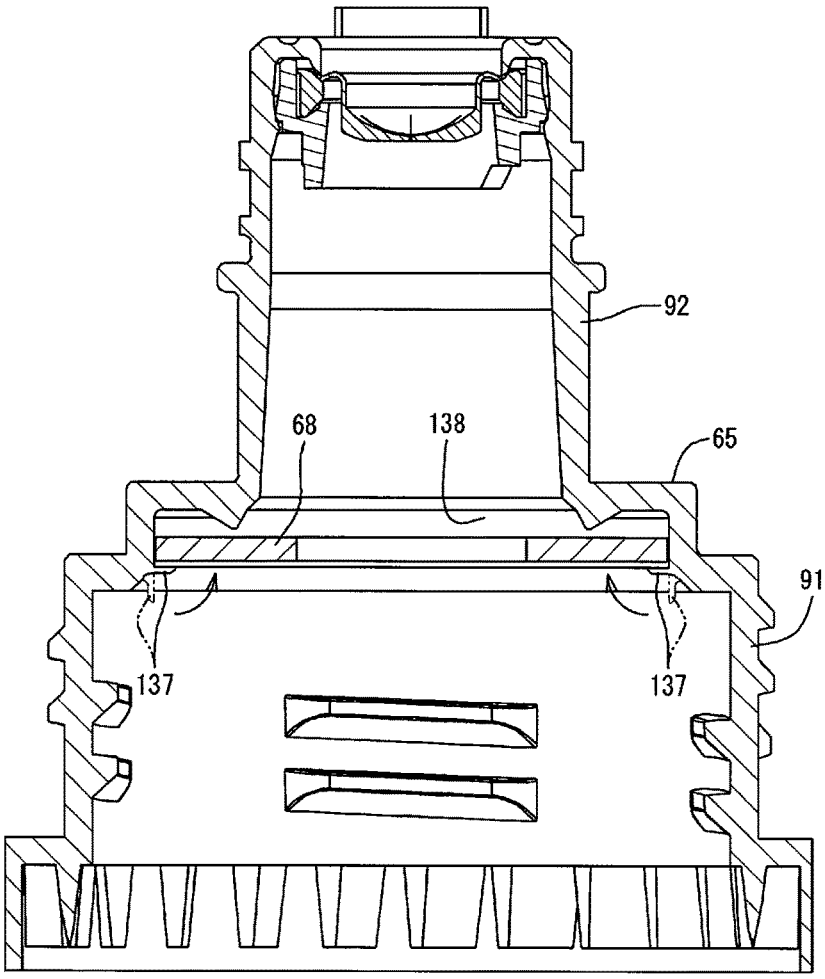
FIG. 19 is a sectional view schematically illustrating an ink outlet forming portion according to Modification 2.

According to Modification 2, as shown in FIG. 18, fixing claws 137 may be provided on the inner side of the ink outlet forming portion 65, such as to prevent dropout of the seal member 68. As shown in FIG. 19 that is a sectional view schematically illustrating an ink outlet forming portion 65 of Modification 2, a receiving region 138 is provided in the ink outlet forming portion 65 to place the seal member 68 therein. The fixing claws 137 are located at positions that initially do not overlap with the receiving region 138 in the plan view in the direction from the joint portion 91 toward the cylindrical portion 92. In this state, the seal member 68 is placed in the receiving region 138, and the fixing claws 137 are plastically deformed in the directions of arrows by caulking, bending or the like, such as to be protruded into the receiving region 138. The fixing claws 137 thus prevent dropout of the seal member 68 from the receiving region 138 toward the joint portion 91.

In any of the embodiment and the modifications described above, the ink ejection apparatus may be a liquid ejection apparatus configured to inject, eject or apply and thereby consume any liquid other than ink. The state of a liquid ejected in the form of tracing amounts of droplets from the liquid ejection apparatus may include a granular shape, a teardrop shape and a tapered threadlike shape. The liquid herein may be any material that is consumable by the liquid ejection apparatus. The liquid may be any material in the liquid phase. The liquid may be, for example, any material in the liquid phase. The liquid may include, for example, liquid-state materials of high viscosity or low viscosity, sols, aqueous gels and other fluids including inorganic solvents, organic solvents, solutions, liquid resins and liquid metals (metal melts). The liquid is not limited to the liquid state as one of the three states of matter but may include solutions, dispersions and mixtures of the functional solid material particles, such as pigment particles or metal particles, solved in, dispersed in or mixed with a solvent. Typical examples of the liquid may include ink described in the above embodiment and liquid crystal. The ink herein may include general water-based inks and oil-based inks, as well as various liquid compositions, such as gel inks and hot-melt inks. The liquid ejection apparatus may include, for example, a liquid ejection apparatus configured to eject a liquid that includes a material such as an electrode material or a color material in the form of a dispersion or in the form of a solution and is used for manufacturing liquid crystal displays, EL (electroluminescence) displays, field emission displays, and color filters. The liquid ejection apparatus may also include a liquid ejection apparatus configured to eject a bioorganic material used for manufacturing biochips, a liquid ejection apparatus used as a precision pipette and configured to eject a sample liquid, a printing apparatus and a microdispenser. The liquid ejection apparatus may further include a liquid ejection apparatus for pinpoint ejection of lubricating oil on precision machines such as watches and cameras and a liquid ejection apparatus configured to eject a transparent resin solution, such as an ultraviolet curable resin solution, onto a substrate in order to manufacture a hemispherical microlens (optical lens) used for, for example, optical communication elements. Another example of the liquid ejection apparatus may be a liquid ejection apparatus configured to eject an acidic or alkaline etching solution in order to etch a substrate or the like.

The disclosure is not limited to any of the embodiment and the modifications described above but may be implemented by a diversity of other configurations without departing from the scope of the disclosure. For example, the technical features of any of the embodiment and the modifications may be replaced or combined appropriately, in order to solve part or all of the problems described above or in order to achieve part or all of the advantageous effects described above. Any of the technical features may be omitted appropriately unless the technical feature is described as essential herein. According to the above embodiment, the ink bottle is made of a material having elasticity. According to a modification, the whole or part of the ink bottle may be made of another material, such as a glass material, a ceramic material or a metal material. The present disclosure may be implemented by aspects described below.

[Aspect 1] According to one aspect of the disclosure, there is provided an ink bottle. The ink bottle comprises a container main body configured to contain ink that is to be supplied to an ink tank, an ink outlet forming portion provided on an end of the container main body and configured to include an ink outlet that causes the ink to be flowed out from the container main body, and a valve provided in the ink outlet forming portion and configured to seal the ink outlet in an openable and closable manner.

The ink outlet is formed in an end face of the ink outlet forming portion. The end face is arranged to face an opposite side of the ink outlet forming portion that is opposite to a container main body side thereof. A first recess is formed in an outer side portion of the ink outlet on the end face to be recessed toward the container main body side.

In the ink bottle of this aspect, the valve is provided in the ink outlet forming portion such as to seal the ink outlet in an openable and closable manner. The valve accordingly serves to suppress leakage of the ink contained in the container main body from the ink outlet, for example, even when the ink bottle is inclined with the ink outlet facing down. Additionally, in the ink bottle of this aspect, the first recess is formed in the end face where the ink outlet is formed. The first recess is thus likely to block the ink dripping from the ink outlet onto the end face. This configuration is likely to prevent the ink dripping from the ink outlet onto the end face from being diffused toward the container main body. The ink bottle of this configuration accordingly has the enhanced convenience.

[Aspect 2] In the ink bottle of the above aspect, a second recess may be provided in an outer circumferential portion of the container main body to be recessed inward of the container main body.

In the ink bottle of this aspect, the second recess is provided in the outer circumferential portion of the container main body. This configuration causes the container main body to be reinforced by the second recess. This configuration reduces deformation of the container main body under application of, for example, a squeezing force to the container main body and thereby suppresses the ink contained in the container main body from leaking out. The ink bottle of this configuration accordingly has the enhanced convenience.

[Aspect 3] In the ink bottle of the above aspect, the ink outlet forming portion is configured to include a cylindrical portion that is in a cylindrical form and is arranged to surround the ink outlet. In the ink bottle of the above aspect, a level difference is formed in an outer wall of the cylindrical portion.

In the ink bottle of this aspect, the level difference is formed in the outer wall of the cylindrical portion, so that a wall connecting the level difference is likely to block the ink.

This configuration is thus likely to prevent the ink dripping from the ink outlet onto the cylindrical portion from being diffused toward the container main body. The ink bottle of this configuration accordingly has the enhanced convenience.

[Aspect 4] In the ink bottle of the above aspect, the ink tank is configured to include a connection portion that is connectable with the ink outlet. In the ink bottle of the above aspect, the ink bottle further comprises a positioning element configured to specify a position of the valve relative to the ink tank when the ink outlet is connected with the connection portion of the ink tank and the valve is opened. In the ink bottle of the above aspect, the positioning element is located on an outer side of the cylindrical portion of the ink outlet forming portion and is joined with the cylindrical portion via a coupling element. In the ink bottle of the above aspect, the coupling element is provided at a position farther from the ink outlet than the level difference in an axial direction of a center axis of the ink outlet.

In the ink bottle of this aspect, the level difference formed in the cylindrical portion is provided at the position nearer to the ink outlet than the coupling element. The level difference is thus likely to block the ink dripping from the ink outlet onto the cylindrical portion before reaching the coupling element. As a result, the ink dripping from the ink outlet onto the cylindrical portion is less likely to reach the coupling element. This configuration is likely to prevent diffusion of ink toward the positioning element.

What is claimed is:

1. An ink bottle, comprising:

a container main body configured to contain ink that is to be supplied to an ink tank;

an ink outlet forming portion provided on an end of the container main body and configured to include an ink outlet that causes the ink to be flowed out from the container main body;

a valve provided in the ink outlet forming portion and configured to seal the ink outlet in an openable and closable manner, wherein the ink outlet is formed in an end face of the ink outlet forming portion, the end face is arranged to face an opposite side of the ink outlet forming portion that is opposite to a container main body side thereof, a first recess is formed in an outer side portion of the ink outlet on the end face to be recessed toward the container main body side, the ink outlet forming portion is configured to include a cylindrical portion that is in a cylindrical form and is arranged to surround the ink outlet, a level difference is formed in an outer wall of the cylindrical portion, and the ink tank is configured to include a connection portion that is connectable with the ink outlet; and a positioning element configured to specify a position of the valve relative to the ink tank when the ink outlet is connected with the connection portion of the ink tank and the valve is opened, wherein the positioning element is located on an outer side of the cylindrical portion of the ink outlet forming portion and is joined with the cylindrical portion via a coupling element, and the coupling element is provided at a position farther from the ink outlet than the level difference in an axial direction of a center axis of the ink outlet.

2. The ink bottle according to claim 1, wherein a second recess is provided in an outer circumferential portion of the container main body to be recessed inward of the container main body, and the second recess is positioned closer to an end of the container main body that is opposite to an end of the container main body corresponding to the ink outlet forming portion.

3. The ink bottle according to claim 1, wherein at least a radial outer side of the first recess is completely surrounded by a wall.

4. The ink bottle according to claim 1, wherein the first recess is open and not filled when the ink bottle is mounted to the ink tank.

5. The ink bottle according to claim 1, wherein the first recess is open and not filled when a cover member covers the ink outlet forming portion.

6. An ink bottle, comprising:

a container main body configured to contain ink that is to be supplied to an ink tank;

an ink outlet forming portion provided on an end of the container main body and configured to include an ink outlet that causes the ink to be flowed out from the container main body; and a valve provided in the ink outlet forming portion and configured to seal the ink outlet in an openable and closable manner, wherein the ink outlet is formed in an end face of the ink outlet forming portion, the end face is arranged to face an opposite side of the ink outlet forming portion that is opposite to a container main body side thereof, and a first recess is formed in an outer side portion of the ink outlet on the end face to be recessed toward the container main body side, wherein the first recess is open and not filled when the ink bottle is mounted to the ink tank.

7. The ink bottle according to claim 6, wherein a second recess is provided in an outer circumferential portion of the container main body to be recessed inward of the container main body, and the second recess is positioned closer to an end of the container main body that is opposite to an end of the container main body corresponding to the ink outlet forming portion.

8. The ink bottle according to claim 6, wherein the ink outlet forming portion is configured to include a cylindrical portion that is in a cylindrical form and is arranged to surround the ink outlet, and a level difference is formed in an outer wall of the cylindrical portion.

9. The ink bottle according to claim 6, wherein at least a radial outer side of the first recess is completely surrounded by a wall.

10. The ink bottle according to claim 6, wherein the first recess is open and not filled when a cover member covers the ink outlet forming portion.

11. An ink bottle, comprising:

a container main body configured to contain ink that is to be supplied to an ink tank;

an ink outlet forming portion provided on an end of the container main body and configured to include an ink outlet that causes the ink to be flowed out from the container main body; and a valve provided in the ink outlet forming portion and configured to seal the ink outlet in an openable and closable manner, wherein the ink outlet is formed in an end face of the ink outlet forming portion, the end face is arranged to face an opposite side of the ink outlet forming portion that is opposite to a container main body side thereof, and a first recess is formed in an outer side portion of the ink outlet on the end face to be recessed toward the container main body side, wherein the first recess is open and not filled when a cover member covers the ink outlet forming portion.

12. The ink bottle according to claim 11, wherein a second recess is provided in an outer circumferential portion of the container main body to be recessed inward of the container main body, and the second recess is positioned closer to an end of the container main body that is opposite to an end of the container main body corresponding to the ink outlet forming portion.

13. The ink bottle according to claim 11, wherein the ink outlet forming portion is configured to include a cylindrical portion that is in a cylindrical form and is arranged to surround the ink outlet, and a level difference is formed in an outer wall of the cylindrical portion.

14. The ink bottle according to claim 11, wherein at least a radial outer side of the first recess is completely surrounded by a wall.

* * * * *